US011236934B2

(12) United States Patent
Tashiro et al.

(10) Patent No.: US 11,236,934 B2
(45) Date of Patent: Feb. 1, 2022

(54) REFRIGERATION CYCLE APPARATUS

(71) Applicant: Mitsubishi Electric Corporation, Tokyo (JP)

(72) Inventors: Yusuke Tashiro, Tokyo (JP); Yasuhide Hayamaru, Tokyo (JP); Masakazu Kondo, Tokyo (JP); Masakazu Sato, Tokyo (JP); Naoki Nakagawa, Tokyo (JP); Atsushi Kawashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/961,300

(22) PCT Filed: Jun. 19, 2018

(86) PCT No.: PCT/JP2018/023243
§ 371 (c)(1),
(2) Date: Jul. 10, 2020

(87) PCT Pub. No.: WO2019/146139
PCT Pub. Date: Aug. 1, 2019

(65) Prior Publication Data

US 2021/0080161 A1 Mar. 18, 2021

(30) Foreign Application Priority Data

Jan. 26, 2018 (WO) ..... PCT/JP2018/002474

(51) Int. Cl.
*F25B 47/02* (2006.01)
*F25B 41/31* (2021.01)
(Continued)

(52) U.S. Cl.
CPC ..... *F25B 47/022* (2013.01); *F25B 39/00* (2013.01); *F25B 41/20* (2021.01); *F25B 41/31* (2021.01);
(Continued)

(58) Field of Classification Search
CPC ..... F25B 47/02; F25B 47/022; F25B 47/025; F25B 41/31; F25B 41/32; F25B 41/325;
(Continued)

(56) References Cited

U.S. PATENT DOCUMENTS 6,393,858 B1 * 5/2002 Mezaki ..... F24F 3/065 62/335
7,237,405 B2 * 7/2007 Takegami ..... F25B 13/00 62/498
(Continued)

FOREIGN PATENT DOCUMENTS

EP 2927623 A1 10/2015
JP S49-052343 A 5/1974
(Continued)

OTHER PUBLICATIONS

European Search Report dated Feb. 18, 2021, issued in corresponding European Patent Application No. 18902268.4.
(Continued)

*Primary Examiner* — Jianying C Atkisson
*Assistant Examiner* — Miguel A Diaz
(74) *Attorney, Agent, or Firm* — Posz Law Group, PLC

(57) ABSTRACT

A refrigeration cycle apparatus includes: a first four-way valve having first to fourth ports; a second four-way valve and a third four-way valve each having fifth to eighth ports; a compressor; a discharge pipe connecting a discharge port of the compressor and the first port; a suction pipe connecting a suction port of the compressor and the second port; a first high pressure pipe connecting the discharge pipe and the fifth ports; a second high pressure pipe connecting the third port and the first high pressure pipe; a first valve provided at the first high pressure pipe; a second valve provided at the second high pressure pipe; a low pressure pipe connecting the suction pipe and the sixth ports; a first outdoor heat
(Continued)

exchanger connected with the seventh port of the second four-way valve; a second outdoor heat exchanger connected with the seventh port of the third four-way valve; and an indoor heat exchanger connected with the fourth port.

5 Claims, 10 Drawing Sheets

(51) Int. Cl.
*F25B 41/20* (2021.01)
*F25B 49/02* (2006.01)
*F25B 39/00* (2006.01)

(52) U.S. Cl.
CPC ..... *F25B 49/02* (2013.01); *F25B 2347/02* (2013.01); *F25B 2600/2515* (2013.01)

(58) Field of Classification Search
CPC ..... F25B 41/33; F25B 41/335; F25B 41/34; F25B 41/345; F25B 41/347; F25B 41/35; F25B 41/355; F25B 41/36; F25B 41/20; F25B 41/24; F25B 41/28; F25B 39/00; F25B 49/02; F25B 2347/02; F25B 2347/021; F25B 2347/022; F25B 2347/023; F25B 2600/2515; F25B 2600/2507; F25B 2600/2511; F25B 2313/02322; F25B 2313/02332; F25B 2313/0251; F25B 2313/02522; F25B 2313/02532
See application file for complete search history.

(56) References Cited

U.S. PATENT DOCUMENTS 9,958,191 B2 * 5/2018 Kawano ..... F25B 49/027
2004/0093893 A1 * 5/2004 Tanimoto ..... F25B 49/025 62/510
2011/0232308 A1 * 9/2011 Morimoto ..... F25B 13/00 62/132
2013/0098092 A1 * 4/2013 Wakamoto ..... F25B 5/02 62/278
2014/0116078 A1 * 5/2014 Doumyou ..... F28D 1/0477 62/238.6
2015/0292756 A1 * 10/2015 Takenaka ..... F24F 5/001 62/160
2015/0292789 A1 * 10/2015 Takenaka ..... F25B 47/022 62/140
2015/0369498 A1 * 12/2015 Motomura ..... F25B 47/025 62/160
2016/0116202 A1 * 4/2016 Takenaka ..... F25D 21/002 62/140
2016/0273795 A1 * 9/2016 Takenaka ..... F25B 47/022
2016/0370045 A1 * 12/2016 Takenaka ..... F28D 1/0443
2018/0328635 A1 * 11/2018 Tashiro ..... F25B 41/20

FOREIGN PATENT DOCUMENTS

JP 2002-107014 A 4/2002
JP 2011-052883 A 3/2011
JP 2011-144960 A 7/2011
JP 2012-013363 A 1/2012
WO 2017/094148 A1 6/2017

OTHER PUBLICATIONS

Japanese Office Action dated Mar. 2, 2021, issued in corresponding Japanese Patent Application No. 2019-567832 (and English Machine Translation).
International Search Report of the International Searching Authority dated Sep. 11, 2018 for the corresponding international application No. PCT/JP2018/023243 (and English translation).
Office Action dated Jul. 5, 2021 issued in corresponding CN patent application No. 201880086721.5 ( and English translation).

* cited by examiner

Comparative Example

REFRIGERATION CYCLE APPARATUS

CROSS REFERENCE TO RELATED APPLICATIONS

This application is a U.S. national stage application of PCT/JP2018/023243 filed on Jun. 19, 2018, which claims priority to International Patent Application No. PCT/JP2018/002474 filed on Jan. 26, 2018, the contents of which are incorporated herein by reference.

TECHNICAL FIELD

The present disclosure relates to a refrigeration cycle apparatus that is capable of performing a heating operation, a defrosting operation, and a simultaneous heating and defrosting operation.

BACKGROUND ART

Patent Literature 1, FIG. 1, discloses an air-conditioning apparatus. The air-conditioning apparatus includes an outdoor heat exchanger that includes a first heat exchanger and a second heat exchanger. In the air-conditioning apparatus, the first heat exchanger and the second heat exchanger are alternately defrosted, whereby the outdoor heat exchanger can be defrosted without stopping a heating operation. The air-conditioning apparatus is provided with a flow switching unit that causes high-temperature, high-pressure refrigerant from a compressor to flow through a heat exchangers to be defrosted. The flow switching unit includes two four-way valves.

CITATION LIST

Patent Literature

Patent Literature 1: International Publication No. WO 2017/094148

SUMMARY OF INVENTION

Technical Problem

In general, an air-conditioning apparatus includes a differential pressure drive type four-way valve as a mechanism that switches the operation of the apparatus between a cooling operation and a heating operation. The differential pressure drive type four-way valve has a high pressure port connected with a discharge side of a compressor and a low pressure port connected with a suction side of the compressor. The differential pressure-drive type four-way valve is operated by a differential pressure between a high pressure and a low pressure. Therefore, in either the cooling operation or the heating operation, the high pressure port needs to be kept at a high pressure, and the low pressure port needs to be kept at a low pressure. When the pressure of the high pressure port is lower than the pressure of the low pressure port, the differential pressure-drive type four-way valve does not normally operate.

In each of the four-way valves used as the flow switching unit in Patent Literature 1, a port that is kept at a high pressure during the cooling operation is kept at a low pressure during the heating operation, whereas a port that is kept at a low pressure during the cooling operation is kept at a high pressure during the heating operation. Thus, a common differential pressure drive type four-way valve cannot be used as the flow switching unit. Therefore, in the air-conditioning apparatus disclosed in Patent Literature 1, the configuration of a refrigerant circuit is complicated.

The present disclosure is applied to solve the above problem, and relates to a refrigeration cycle apparatus in which a configuration of a refrigerant circuit that is capable of performing a heating operation, a defrosting operation, and a simultaneous heating and defrosting operation can be further simplified.

Solution to Problem

A refrigeration cycle apparatus according to an embodiment of the present disclosure includes: a first four-way valve having a first port, a second port, a third port, and a fourth port; a second four-way valve and a third four-way valve each having a fifth port, a sixth port, a seventh port, and an eighth port, the eighth port being closed; a compressor having a suction port from which refrigerant is sucked into the compressor and a discharge port from which the refrigerant is discharged from the compressor; a discharge pipe connecting the discharge port and the first port; a suction pipe connecting the suction port and the second port; a first high pressure pipe connecting the discharge pipe and the fifth port of the second four-way valve and the fifth port of the third four-way valve; a second high pressure pipe connecting the third port and a bifurcation provided at the first high pressure pipe; a first valve provided at part of the first high pressure pipe that is located between the discharge pipe and the bifurcation; a second valve provided at the second high pressure pipe; a low pressure pipe connecting the suction pipe and the sixth port of the second four-way valve and the sixth port of the third four-way valve; a first outdoor heat exchanger connected with the seventh port of the second four-way valve; a second outdoor heat exchanger connected with the seventh port of the third four-way valve; and an indoor heat exchanger connected with the fourth port.

Advantageous Effects of Invention

According to the embodiment of the present disclosure, whichever of the heating operation, the defrosting operation, and the simultaneous heating and defrosting operation is performed, the pressure of the fifth port of the second four-way valve is kept higher than the pressure of the sixth port of the second four-way valve, and the pressure of the fifth port of the third four-way valve is kept higher than the pressure of the sixth port of the third four-way valve. Therefore, as each of the second four-way valve and the third four-way valve, the differential pressure-drive type four-way valve can be used. According to the embodiment of the present disclosure, the configuration of the refrigerant circuit that is capable of the heating operation, the defrosting operation, and the simultaneous heating and defrosting operation can be further simplified.

DESCRIPTION OF EMBODIMENTS

Embodiment 1

Figure 1:
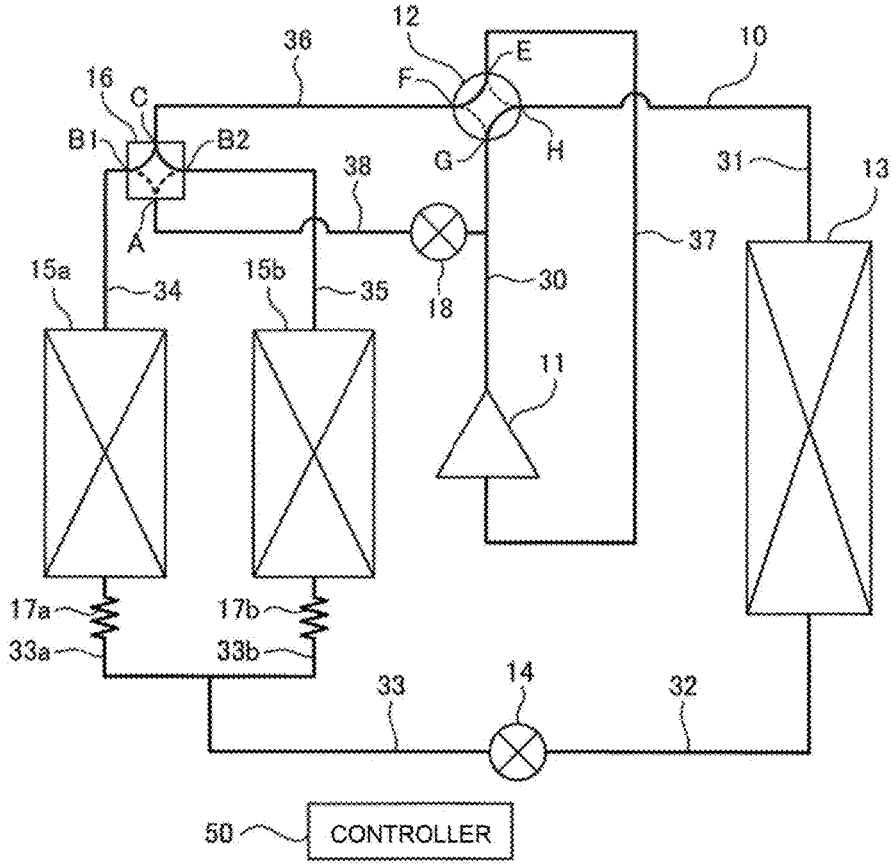
FIG. 1 is a refrigerant circuit diagram illustrating a configuration of a refrigeration cycle apparatus according to Embodiment 1 of the present disclosure.

A refrigeration cycle apparatus according to Embodiment 1 of the present disclosure is described.

Japanese Unexamined Patent Application Publication No. 2012-13363 discloses an air-conditioning apparatus including a refrigeration cycle. The refrigeration cycle includes a compressor, a four-way valve, outdoor heat exchangers connected in parallel, pressure-reducing devices provided on inlet sides of the respective outdoor heat exchangers, and an indoor heat exchanger. The refrigeration cycle is configured to perform a heating operation, a reverse cycle defrosting operation, and a defrosting-heating operation in which some of the outdoor heat exchangers operate as condensers and the other outdoor heat exchangers operate as evaporators.

When the air-conditioning apparatus disclosed in Japanese Unexamined Patent Application Publication No. 2012-13363 performs the defrosting-heating operation, the outdoor heat exchangers can be defrosted while the heating operation is continued. However, during the defrosting-heating operation, since part of the defrosting capacity of the refrigeration cycle is used for the heating, the time required for completion of the defrosting is longer than in the reverse cycle defrosting operation. Therefore, in the above air-conditioning apparatus, since the defrosting-heating operation is performed, an average heating capacity per one cycle from completion of defrosting to completion of subsequent defrosting that follows the heating operation may be reduced.

The above embodiment is applied to solve the above problem, and an object of the embodiment is to provide a refrigeration cycle apparatus that can further improve the average heating capacity.

A refrigeration cycle apparatus according to Embodiment 1 includes a refrigerant circuit and a controller. The refrigerant circuit includes a compressor, a first outdoor heat exchanger, a second outdoor heat exchanger, and an indoor heat exchanger. The controller controls the refrigerant circuit. The compressor operates at a variable operating frequency that falls within a predetermined operating frequency range. The refrigerant circuit is capable of performing a heating operation, a defrosting operation, and a simultaneous heating and defrosting operation. In the heating operation, the first outdoor heat exchanger and the second outdoor heat exchanger operate as evaporators, and the indoor heat exchanger operates as a condenser. In the defrosting operation, the first outdoor heat exchanger and the second outdoor heat exchanger operate as condensers. In the simultaneous heating and defrosting operation, one of the first outdoor heat exchanger and the second outdoor heat exchanger operates as an evaporator, and the other of the first outdoor heat exchanger and the second outdoor heat exchanger and the indoor heat exchanger operate as condensers. During the heating operation, in the case where a value obtained by subtracting the operating frequency of the compressor from the maximum operating frequency that is an upper limit of the operating frequency range is greater than or equal to a threshold, the controller causes the simultaneous heating and defrosting operation to be performed after the heating operation. During the heating operation, in the case where the value obtained by subtracting the operating frequency of the compressor from the maximum operating frequency is less than the threshold, the controller causes the defrosting operation to be performed after the heating operation.

According to Embodiment 1, it is possible to more accurately determine which of the simultaneous heating and defrosting operation and the defrosting operation should be performed after the heating operation, and thus further improve the average heating capacity per one cycle from completion of defrosting to completion of subsequent defrosting that follows the heating operation.

FIG. 1 is a refrigerant circuit diagram illustrating a configuration of a refrigeration cycle apparatus according to Embodiment 1. In Embodiment 1, an air-conditioning apparatus is provided by way of example as the refrigeration cycle apparatus. As illustrated in FIG. 1, the refrigeration cycle apparatus includes a refrigerant circuit 10 in which refrigerant is circulated. The refrigerant circuit 10 includes a compressor 11, a first flow switching device 12, an indoor heat exchanger 13, an expansion valve 14, a first outdoor heat exchanger 15*a*, a second outdoor heat exchanger 15*b*, and a second flow switching device 16. As described below, the refrigerant circuit 10 is capable of performing the heating operation, a reverse cycle defrosting operation (hereinafter, simply referred to as "defrosting operation"), the simultaneous heating and defrosting operation, and a cooling operation.

The refrigeration cycle apparatus includes an outdoor unit installed outdoors and an indoor unit installed indoors. The compressor 11, the first flow switching device 12, the expansion valve 14, the first outdoor heat exchanger 15*a*, the second outdoor heat exchanger 15*b*, and the second flow switching device 16 are provided in the outdoor unit. The indoor heat exchanger 13 is provided in the indoor unit. The refrigeration cycle apparatus further includes a controller 50 that controls the refrigerant circuit 10.

The compressor 11 is a fluid machine that sucks and compresses low-pressure gas refrigerant into high-pressure gas refrigerant, and discharges the high-pressure gas refrigerant. As the compressor 11, an inverter compressor that is adjustable in operating frequency is used. In the compressor 11, an operating frequency range is set in advance. The compressor 11 operates under a control by the controller 50, at a variable operating frequency that fall within the operating frequency range.

The first flow switching device 12 switches the flow direction of the refrigerant in the refrigerant circuit 10. As the first flow switching device 12, a four-way valve having four ports E, F, G, and H is used. The first flow switching device 12 can enter a first state in which the ports E and F communicate with each other and the ports G and H communicate with each other, and a second state in which the ports E and H communicate with each other and the ports F and G communicate with each other. By the control by the controller 50, the state of the first flow switching device 12 is set to the first state during the heating operation and the simultaneous heating and defrosting operation, and is set to the second state during the defrosting operation and the cooling operation. In addition, as the first flow switching device 12, a combination of a plurality of two-way valves or three-way valves can also be used.

The indoor heat exchanger 13 is a heat exchanger that transfers heat between refrigerant that flows in the indoor heat exchanger and air sent by an indoor fan (not illustrated) provided in the indoor unit. The indoor heat exchanger 13 operates as a condenser during the heating operation, and operates as an evaporator during the cooling operation.

The expansion valve 14 is a valve that reduces the pressure of the refrigerant. As the expansion valve 14, an electronic expansion valve whose opening degree can be adjusted by the control by the controller 50 is used.

Each of the first outdoor heat exchanger 15*a* and the second outdoor heat exchanger 15*b* is a heat exchanger that transfers heat between the refrigerant that flows in the heat exchanger and air sent by an outdoor fan (not illustrated) provided in the outdoor unit. The first outdoor heat exchanger 15*a* and the second outdoor heat exchanger 15*b* operate as evaporators during the heating operation, and operate as condensers during the cooling operation. The first outdoor heat exchanger 15*a* and the second outdoor heat exchanger 15*b* are connected in parallel in the refrigerant circuit 10. The first outdoor heat exchanger 15*a* and the second outdoor heat exchanger 15*b* are each formed to include vertically divided portions, that is, an upper portion and a lower portion. In this case, the first outdoor heat exchanger 15*a* and the second outdoor heat exchanger 15*b* are also arranged parallel to each other in the flow of the air.

The second flow switching device 16 switches the flow of the refrigerant to switch the operation between the heating operation, the defrosting operation and the cooling operation, and the simultaneous heating and defrosting operation. As the second flow switching device 16, a four-way valve having four ports A, B1, B2, and C is used. The second flow switching device 16 can enter a first state, a second state, and a third state. In the first state, the port C communicates with both the port B1 and the port B2, and the port A communicates with neither the port B1 nor the port B2. In the second state, the port A and the port B1 communicate with each other, and the port C and the port B2 communicate with each other. In the third state, the port A and the port B2 communicate with each other, and the port C and the port B1 communicate with each other. By the control by the controller 50, the state of the second flow switching device 16 is set to the first state during the heating operation, the defrosting operation, and the cooling operation, and is set to the second state or the third state during the simultaneous heating and defrosting operation. As the second flow switching device 16, for example, a flow switching valve identical to a flow switching valve disclosed in International Publication No. WO 2017/094148 is used.

The compressor 11, the first flow switching device 12, the indoor heat exchanger 13, the expansion valve 14, the first outdoor heat exchanger 15*a*, the second outdoor heat exchanger 15*b*, and the second flow switching device 16 are connected by refrigerant pipes, for example, pipes 30 to 38. The pipe 30 connects a discharge port of the compressor 11 and the port G of the first flow switching device 12. The pipe 31 connects the port H of the first flow switching device 12 and the indoor heat exchanger 13. The pipe 32 connects the indoor heat exchanger 13 and the expansion valve 14. The pipe 33 branches into pipes 33*a* and 33*b*, and connects the expansion valve 14 and each of the first outdoor heat exchanger 15*a* and the second outdoor heat exchanger 15*b*. The pipes 33*a* and 33*b* are provided with capillary tubes 17*a* and 17*b*, respectively. The pipe 34 connects the first outdoor heat exchanger 15*a* and the port B1 of the second flow switching device 16. The pipe 35 connects the second outdoor heat exchanger 15*b* and the port B2 of the second flow switching device 16, The pipe 36 connects the port C of the second flow switching device 16 and the port F of the first flow switching device 12. The pipe 37 connects the port E of the first flow switching device 12 and a suction port of the compressor 11.

The pipe 38 connects the pipe 30 and the port A of the second flow switching device 16. The pipe 38 forms a hot gas bypass flow passage that supplies part of gas refrigerant discharged from the compressor 11 to the first outdoor heat exchanger 15*a* or the second outdoor heat exchanger 15*b*. The pipe 38 is provided with a bypass expansion valve 18. As the bypass expansion valve 18, an electronic expansion valve is used. By the control by the controller 50, the bypass expansion valve 18 is set to be in a closed state during the heating operation, the defrosting operation, and the cooling operation, and is set to in an opened state during the simultaneous heating and defrosting operation.

The controller 50 includes a microcomputer provided with a CPU, a ROM, a RAM, an I/O port, etc. To the controller 50, the following signals are input: a detection signal from each of a temperature sensor and a pressure sensor that are provided in the refrigerant circuit 10; and an operation signal from an operation unit that is operated by a user. In response to the input signals, the controller 50 controls operation of the entire refrigeration cycle apparatus that includes the compressor 11, the first flow switching device 12, the expansion valve 14, the second flow switching device 16, the bypass expansion valve 18, the indoor fan, and the outdoor fan.

Figure 2:
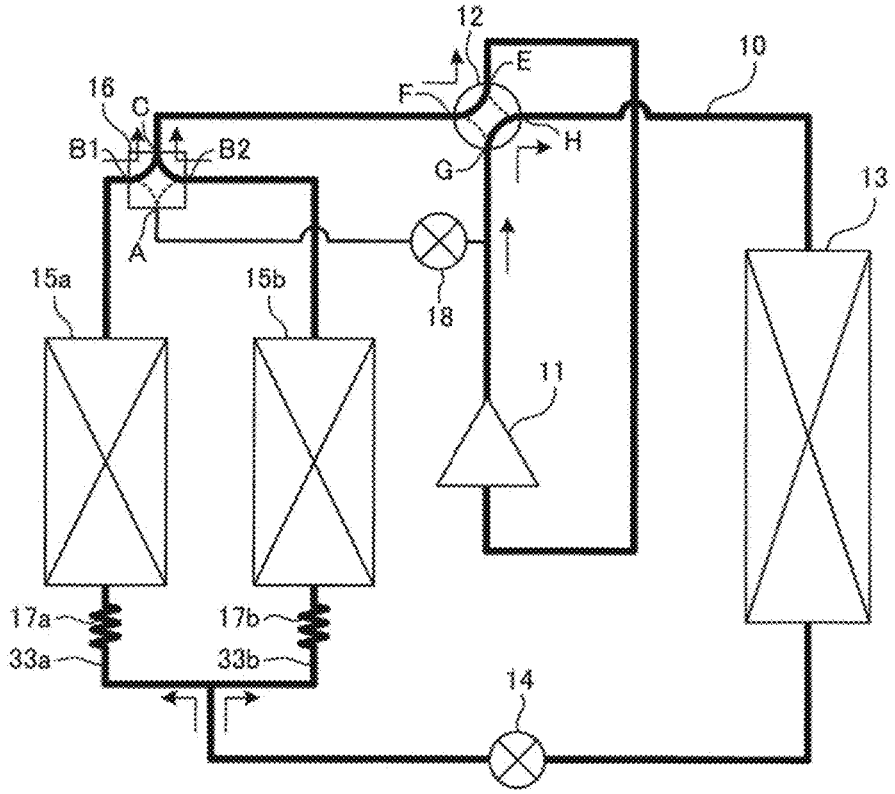
FIG. 2 is a diagram illustrating a state of the refrigeration cycle apparatus according to Embodiment 1 of the present disclosure during a heating operation.

Next, the operation of the refrigeration cycle apparatus during the heating operation will be described. FIG. 2 is a diagram illustrating the state of the refrigeration cycle apparatus according to Embodiment 1 during the heating operation. As illustrated in FIG. 2, during the heating operation, the first flow switching device 12 is set to be in the first state in which the ports E and F communicate with each other and the ports G and H communicate with each other. The second flow switching device 16 is set to be in the first state in which the port C communicates with the ports B1 and B2. The bypass expansion valve 18 is set to be, for example, in the closed state.

The high-pressure gas refrigerant discharged from the compressor 11 flows into the indoor heat exchanger 13 through the first flow switching device 12. During the heating operation, the indoor heat exchanger 13 operates as a condenser. More specifically, at the indoor heat exchanger 13, the refrigerant that flows in the indoor heat exchanger 13 and indoor air sent by the indoor fan exchange heat with each other, and condensation heat of the refrigerant is transferred to the indoor air. As a result, the gas refrigerant that has flowed into the indoor heat exchanger 13 is condensed to change into high-pressure liquid refrigerant. In addition, the indoor air sent by the indoor fan is heated by the heat transferred from the refrigerant.

The liquid refrigerant that has flowed out of the indoor heat exchanger 13 is reduced in pressure by the expansion valve 14 to change into low-pressure two-phase refrigerant. After flowing out of the expansion valve 14, the two-phase refrigerant branches off to flow into the pipe 33*a* and the pipe 33*b*. The two-phase refrigerant that has flowed into the pipe 33*a* is further reduced in pressure in the capillary tube 17*a*, and then flows into the first outdoor heat exchanger 15*a*. By contrast, the two-phase refrigerant that has flowed into the pipe 33*b* is further reduced in pressure in the capillary tube 17*b*, and then flows into the second outdoor heat exchanger 15*b*.

During the heating operation, the first outdoor heat exchanger 15*a* and the second outdoor heat exchanger 15*b* both operate as evaporators. More specifically, at each of the first outdoor heat exchanger 15*a* and the second outdoor heat exchanger 15*b*, the refrigerant that flows in each outdoor heat exchanger and outdoor air sent by the outdoor fan exchange heat with each other, and evaporation heat for the refrigerant is absorbed from the outdoor air. As a result, the two-phase refrigerant that has flowed into each of the first outdoor heat exchanger 15*a* and the second outdoor heat exchanger 15*b* is evaporated to change into low-pressure gas refrigerant. The gas refrigerant that has flowed out of the first outdoor heat exchanger 15*a* and the gas refrigerant that has flowed out of the second outdoor heat exchanger 15*b* join each other in the second flow switching device 16, and the resultant gas refrigerant is sucked into the compressor 11 through the first flow switching device 12. The gas refrigerant sucked into the compressor 11 is compressed into high-pressure gas refrigerant, During the heating operation, the above cycle is continuously repeated.

When the heating operation is continued for a long time, frost may adhere to the first outdoor heat exchanger 15*a* and the second outdoor heat exchanger 15*b*, and heat exchange efficiency of the first outdoor heat exchanger 15*a* and the second outdoor heat exchanger 15*b* may be reduced. Therefore, in order to melt the frost adhering to the first outdoor heat exchanger 15*a* and the second outdoor heat exchanger 15*b*, the defrosting operation or the simultaneous heating and defrosting operation is periodically performed. In the defrosting operation, high-temperature high-pressure gas refrigerant is supplied to both the first outdoor heat exchanger 15*a* and the second outdoor heat exchanger 15*b*, and the first outdoor heat exchanger 15*a* and the second outdoor heat exchanger 15*b* are defrosted by heat transferred from the refrigerant. In the simultaneous heating and defrosting operation, one of the first outdoor heat exchanger 15*a* and the second outdoor heat exchanger 15*b* is operated as the evaporator to cause the heating to continue, while the other of the first outdoor heat exchanger 15*a* and the second outdoor heat exchanger 15*b* is being defrosted by supplying the high-temperature high-pressure gas refrigerant to the other outdoor heat exchanger.

Figure 3:
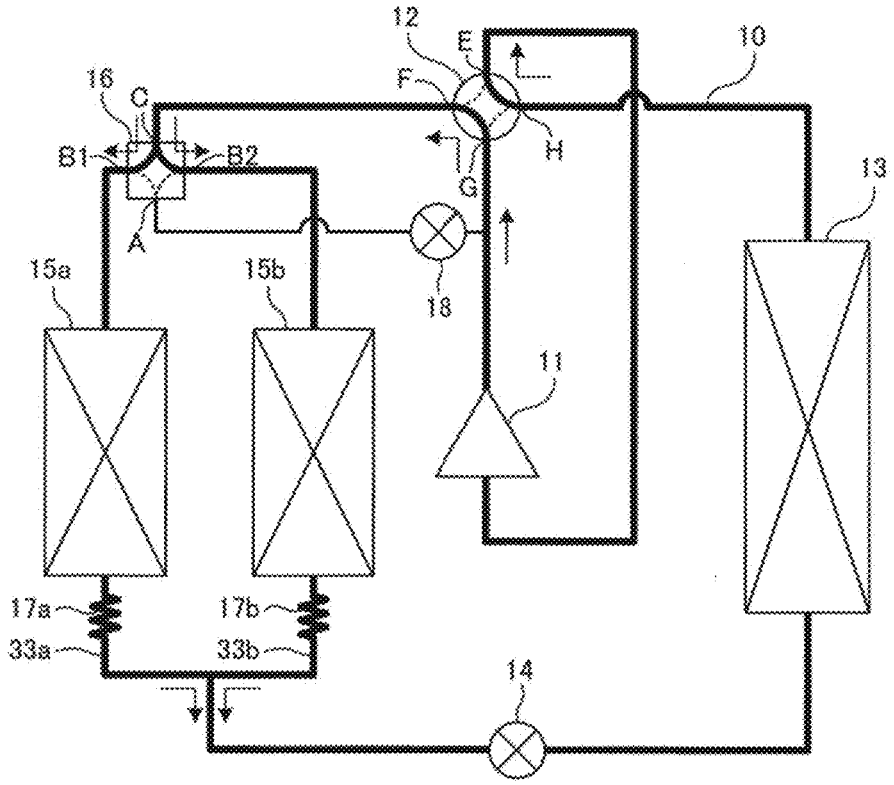
FIG. 3 is a diagram illustrating the state of the refrigeration cycle apparatus according to Embodiment 1 of the present disclosure during a defrosting operation.

The operation of the refrigeration cycle apparatus during the defrosting operation will be described. FIG. 3 is a diagram illustrating the state of the refrigeration cycle apparatus according to Embodiment 1 during the defrosting operation. As illustrated in FIG. 3, during the defrosting operation, the first flow switching device 12 is set to be in the second state in which the port E and the port H communicate with each other and the port F and the port G communicate with each other. The second flow switching device 16 is set to be in the first state where the port C communicates with the port B1 and the port B2. The bypass expansion valve 18 is set to be, for example, in the closed state. The setting of the first flow switching device 12, the second flow switching device 16, and the bypass expansion valve 18 during the defrosting operation is the same as that during the cooling operation.

The high-pressure gas refrigerant discharged from the compressor 11 flows through the first flow switching device 12, and then branches in the second flow switching device 16 to flow into the first outdoor heat exchanger 15*a* and the second outdoor heat exchanger 15*b*. During the defrosting operation, the first outdoor heat exchanger 15*a* and the second outdoor heat exchanger 15*b* both operate as condensers. More specifically, frost adhering to each of the first outdoor heat exchanger 15*a* and the second outdoor heat exchanger 15*b* is melted by heat transferred from the refrigerant that has flowing through each of the first outdoor heat exchanger 15*a* and the second outdoor heat exchanger 15*b*. As a result, the first outdoor heat exchanger 15*a* and the second outdoor heat exchanger 15*b* are defrosted. In addition, the gas refrigerant that has flowed into each of the first outdoor heat exchanger 15*a* and the second outdoor heat exchanger 15*b* is condensed to change into liquid refrigerant.

The liquid refrigerant that has flowed out of the first outdoor heat exchanger 15*a* is reduced in pressure in the capillary tube 17*a*. The liquid refrigerant that has flowed out of the second outdoor heat exchanger 15*b* is reduced in pressure in the capillary tube 17*b*. These liquid refrigerants join each other, and the resultant refrigerant is then further reduced in pressure in the expansion valve 14 to change into low-pressure two-phase refrigerant. The two-phase refrigerant that has flowed out of the expansion valve 14 flows into the indoor heat exchanger 13. During the defrosting operation, the indoor heat exchanger 13 operates as an evaporator. More specifically, in the indoor heat exchanger 13, evaporation heat for the refrigerant that has flowed into the indoor heat exchanger 13 is absorbed from the indoor air. As a result, the two-phase refrigerant that has flowed into the indoor heat exchanger 13 is evaporated to change into low-pressure gas refrigerant. The gas refrigerant that has flowed out of the indoor heat exchanger 13 is sucked into the compressor 11 through the first flow switching device 12. The gas refrigerant sucked into the compressor 11 is compressed into high-pressure gas refrigerant. During the defrosting operation, the above cycle is continuously repeated.

Figure 4:
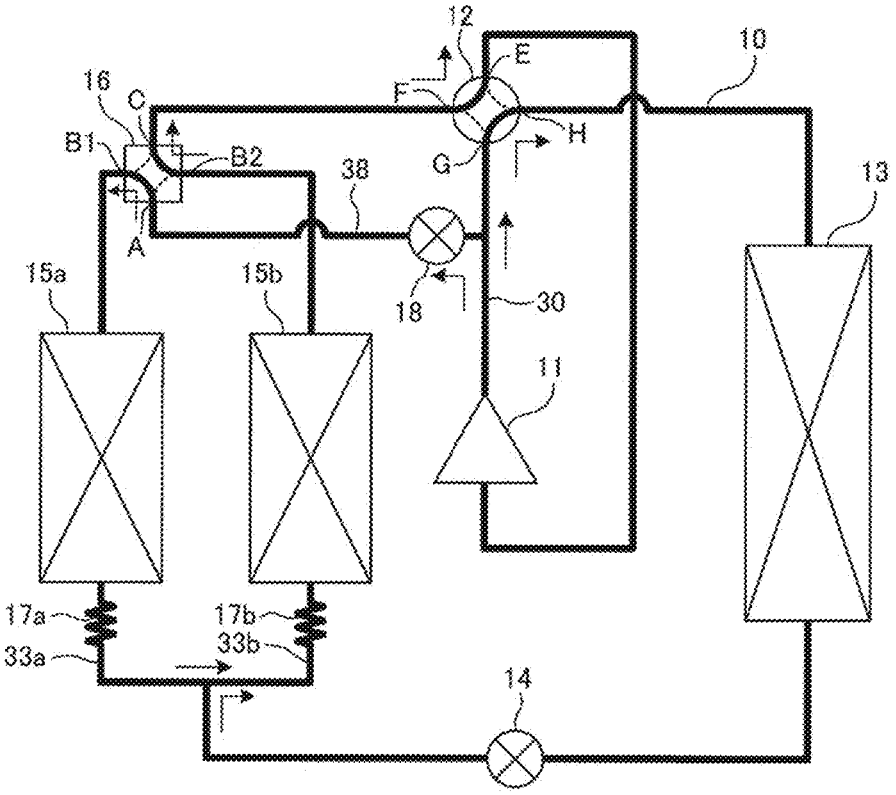
FIG. 4 is a diagram illustrating the state of the refrigeration cycle apparatus according to Embodiment 1 of the present disclosure during a simultaneous heating and defrosting operation.

Next, the operation of the refrigeration cycle apparatus during the simultaneous heating and defrosting operation will be described. FIG. 4 is a diagram illustrating the state of the refrigeration cycle apparatus according to Embodiment 1 during the simultaneous heating and defrosting operation. The simultaneous heating and defrosting operation includes a first operation and a second operation. During the first operation, the first outdoor heat exchanger 15*a* and the indoor heat exchanger 13 operate as condensers, and the second outdoor heat exchanger 15*b* operates as an evaporator. As a result, the heating is continued while the first outdoor heat exchanger 15*a* is being defrosted. During the second operation, the second outdoor heat exchanger 15*b* and the indoor heat exchanger 13 operate as condensers, and the first outdoor heat exchanger 15*a* operates as an evaporator. As a result, the heating is continued while the second outdoor heat exchanger 15*b* is being defrosted. The first operation and the second operation are alternately performed at least once each time the simultaneous heating and defrosting operation is performed. FIG. 4 illustrates the state of the refrigeration cycle apparatus operation during the first operation of the simultaneous heating and defrosting operation.

As illustrated in FIG. 4, during the first operation of the simultaneous heating and defrosting operation, the first flow switching device 12 is set to be in the first state in which the port E and the port F communicate with each other and the port G and the port H communicate with each other. The second flow switching device 16 is set to be in the second state where the port A and the port B1 communicate with each other and the port C and the port B2 communicate with each other. The bypass expansion valve 18 is opened at a predetermined opening degree.

The high-pressure gas refrigerant discharged from the compressor 11 flows through the pipe 38 and then branches off such that part of the high-pressure gas refrigerant flows into the pipe 38. The gas refrigerant that has flowed into the pipe 38 is reduced in pressure in the bypass expansion valve 18, and then flows into the first outdoor heat exchanger 15*a* via the second flow switching device 16. In the first outdoor heat exchanger 15*a*, frost adhering thereto is melted by heat transferred from the refrigerant that flows in the outdoor heat exchanger 15*a*. As a result, the first outdoor heat exchanger 15*a* is defrosted. Furthermore, the gas refrigerant that has flowed into the first outdoor heat exchanger 15*a* is condensed to change into high-pressure liquid refrigerant or two-phase refrigerant, and the high-pressure liquid refrigerant or two-phase refrigerant flows out of the first outdoor heat exchanger 15*a* and is then reduced in pressure in the capillary tube 17*a*.

Of the high-pressure gas refrigerant discharged from the compressor 11, the gas refrigerant other than the gas refrigerant that has flowed into the pipe 38 flows into the indoor heat exchanger 13 via the first flow switching device 12. At the indoor heat exchanger 13, the refrigerant that flows in the indoor heat exchanger 13 and indoor air sent by the indoor fan exchange heat with each other, and condensation heat of the gas refrigerant is transferred to the indoor air. As a result, the gas refrigerant that has flowed into the indoor heat exchanger 13 is condensed to change into high-pressure liquid refrigerant, and the indoor air sent by the indoor fan is heated by the heat transferred from the refrigerant.

The liquid refrigerant that has flowed out of the indoor heat exchanger 13 is reduced in pressure in the expansion valve 14 to change into low-pressure two-phase refrigerant. The two-phase refrigerant that has flowed out of the expansion valve 14 joins the liquid refrigerant or the two-phase refrigerant the pressure of which has been reduced in the capillary tube 17*a*, and the resultant refrigerant then flows into the second outdoor heat exchanger 15*b* through the capillary tube 17*b*. At the second outdoor heat exchanger 15*b*, the refrigerant that flows in the second outdoor heat exchanger 15*b* and the outdoor air sent by the outdoor fan exchange heat with each other, and evaporation heat for the refrigerant is absorbed from the outdoor air. As a result, the two-phase refrigerant that has flowed into the second outdoor heat exchanger 15*b* is evaporated to change into low-pressure gas refrigerant. The gas refrigerant that has flowed out of the second outdoor heat exchanger 15*b* is sucked into the compressor 11 via the second flow switching device 16 and the first flow switching device 12. The gas refrigerant sucked into the compressor 11 is compressed into high-pressure gas refrigerant. During the first operation of the simultaneous heating and defrosting operation, the above cycle is continuously repeated. As a result, the heating is continued while the first outdoor heat exchanger 15*a* is being defrosted.

Although it is not illustrated, during the second operation of the simultaneous heating and defrosting operation, the first flow switching device 12 is set to be in the first state as in the first operation. The second flow switching device 16 is set to be in the third state in which the port A and the port B communicate with each other and the port C and the port B1 communicate with each other. As a result, during the second operation, the heating is continued while the second outdoor heat exchanger 15*b* is being defrosted.

Figure 5:
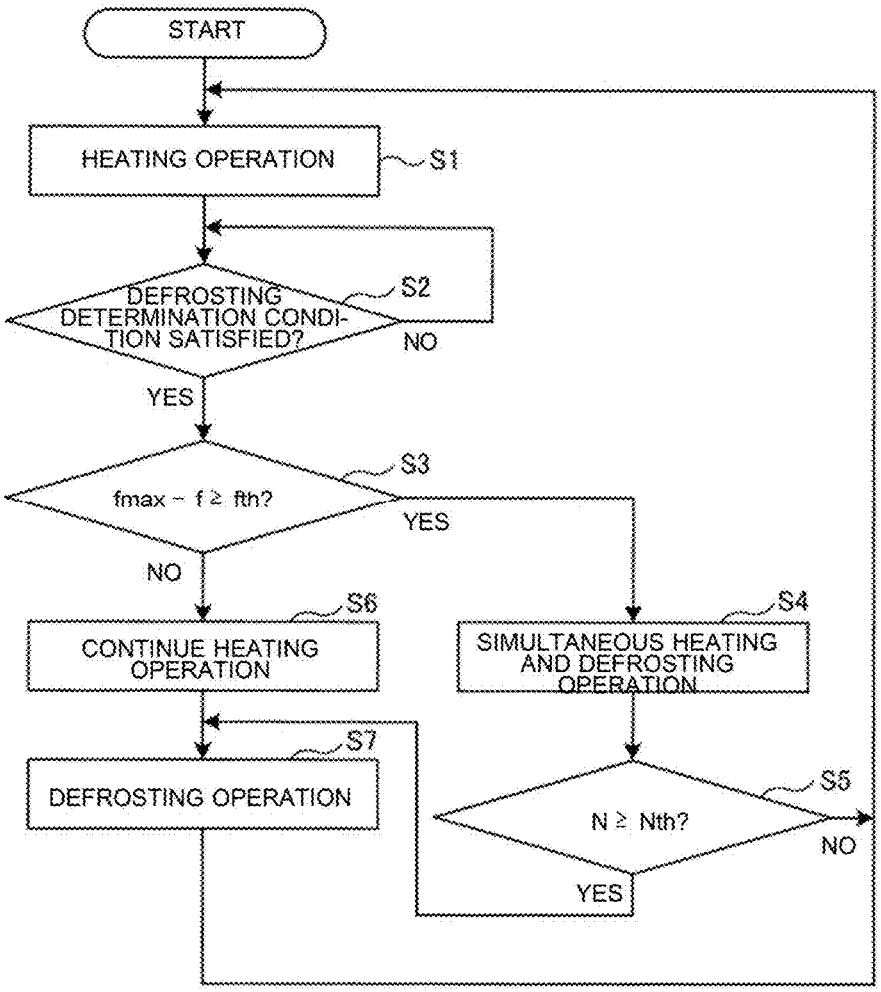
FIG. 5 is a flowchart illustrating a flow of processing by a controller 50 of the refrigeration cycle apparatus according to Embodiment 1 of the present disclosure.

FIG. 5 is a flowchart of the flow of processing by the controller 50 of the refrigeration cycle apparatus according to Embodiment 1. The controller 50 starts the heating operation in response to, for example, a heating operation start signal from the operation unit (step S1). After the heating operation is started, the controller 50 determines whether a defrosting determination condition is satisfied or not (step S2). The defrosting determination condition is that time that has elapsed from the time when the heating operation is started exceeds a threshold time (for example, 20 minutes). In the case where it is determined that the defrosting determination condition is satisfied, the process proceeds to step S3. In the case where it is determined that the defrosting determination condition is not satisfied, the process of step S2 is periodically repeated.

In step S3, the controller 50 acquires, as an operating frequency f, a value of the operating frequency of the compressor 11 at the present time or an average value of the operation frequencies of the compressor 11 during a time period from the time when the heating operation is started to the present time. Thereafter, the controller 50 determines whether or not a value of a frequency difference (fmax−f) obtained by subtracting the operating frequency f from a maximum operating frequency fmax of the compressor 11 is greater than or equal to a threshold fth. The maximum operating frequency fmax is an upper limit value of the operating frequency range of the compressor 11. The values of the maximum operating frequency fmax and the threshold fth are stored in advance in the ROM of the controller 50. The operating frequency of the compressor 11 is substantially proportional to a heating load, since the compressor 11 is controlled such that the operating frequency increases as the heating load increases.

In the case where the value obtained by subtracting the operating frequency f from the maximum operating frequency fmax is greater than or equal to the threshold fth (fmax−f≥fth), the process proceeds to the process of step S4. In contrast, in the case where the value obtained by subtracting the operating frequency f from the maximum operating frequency fmax is less than the threshold fth (fmax−f<fth), the process proceeds to process of step S6.

In step S4, the controller 50 ends the heating operation, and causes the simultaneous heating and defrosting operation to be performed for a predetermined period. The controller 50 includes a counter that stores the number N of times the simultaneous heating and defrosting operation is performed. An initial value of the counter is zero. When causing the simultaneous heating and defrosting operation to be performed, the controller 50 adds one to the value of the number N of times that is stored in the counter.

Next, in step S5, the controller 50 determines whether the number N of times the simultaneous heating and defrosting operation is performed is greater than or equal to a threshold number Nth. In the case where the number N of the times is greater than or equal to the threshold number Nth (N≥Nth), the process proceeds to the process of step S7. The controller 50 may causes the heating operation to be performed before the process proceeds to step S7. In contrast, in the case where the number N of the times is less than the threshold number Nth (N<Nth), the process returns to the process of step S1, and the heating operation is resumed.

In step S6, the controller 50 causes the heating operation to be further continued for a predetermined period, if necessary. Thereafter, the process proceeds to the process of step S7.

In step S7, the controller 50 ends the heating operation or the simultaneous heating and defrosting operation, and causes the defrosting operation to be performed for a predetermined period. Normally, an execution time period of the defrosting operation, in which the defrosting operation is performed, is shorter than an execution period of the simultaneous heating and defrosting operation, in which the simultaneous heating and defrosting operation is performed. Furthermore, when causing the defrosting operation to be performed, the controller 50 initializes the counter and sets the value of the number N of times the simultaneous heating and defrosting operation is performed to zero. After the end of the defrosting operation, the process returns to the process of step S1, and the controller 50 resumes the heating operation.

Figure 6:
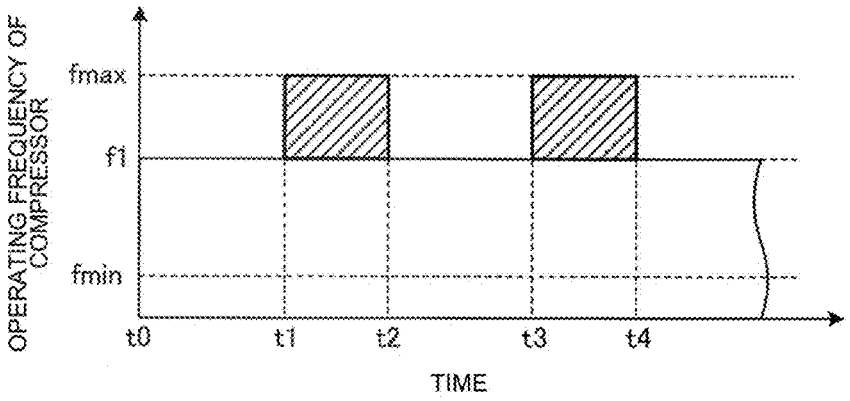
FIG. 6 is a graph illustrating an example of an operating frequency that varies with passage of time in the case where the heating operation and the simultaneous heating and defrosting operation are alternately performed in the refrigeration cycle apparatus according to Embodiment 1 of the present disclosure.
Figure 7:
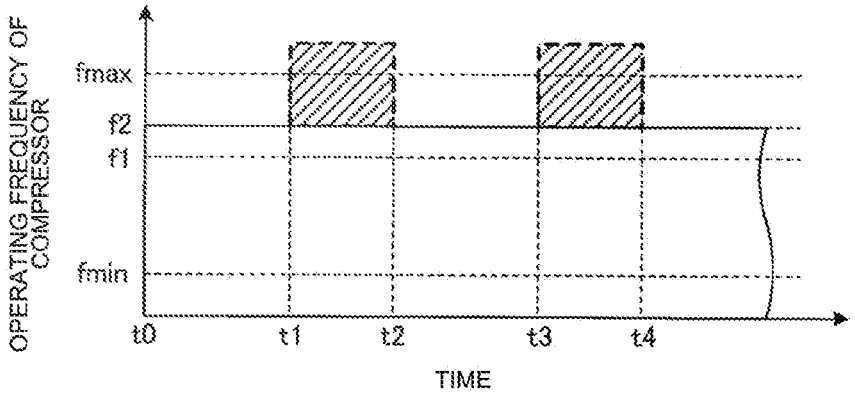
FIG. 7 is a graph illustrating a comparative example of the operating frequency that varies with passage of time in the case where the heating operation and the simultaneous heating and defrosting operation are alternately performed.
Figure 8:
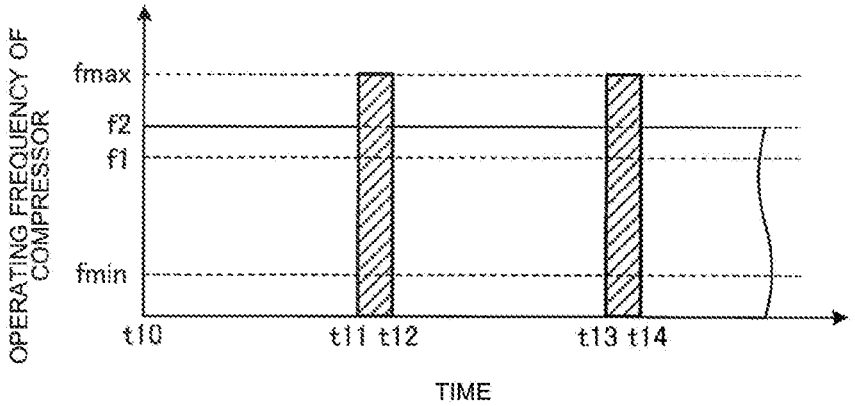
FIG. 8 is a graph illustrating an example of the operating frequency that varies with the passage of time in the case where the heating operation and the defrosting operation are alternately performed in the refrigeration cycle apparatus according to Embodiment 1 of the present disclosure.

FIG. 6 is a graph illustrating an example of the operating frequency that varies with passage of time in the case where the heating operation and the simultaneous heating and defrosting operation are alternately performed in the refrigeration cycle apparatus according to Embodiment 1. In FIG. 6, the horizontal axis indicates time, and the vertical axis indicates the operating frequency of the compressor 11. A lower limit value of the operating frequency range of the compressor 11 will be referred to as a minimum operating frequency fmin. Furthermore, an operating frequency f1 satisfies fmax−f1=fth. In FIG. 6, and FIGS. 7 and 8 which will be referred to below, hatched portions conceptually represents the performance of the compressor 11 assigned to defrosting.

In the example indicated in FIG. 6, a heating operation in which the compressor 11 operates at the operating frequency f1 is performed during a time period from time t0 to time t1 and during a time period from time t2 to time t3. A simultaneous heating and defrosting operation in which the compressor 11 operates at the maximum operating frequency fmax is performed during a time period from time t1 to time t2 and during a time period from time t3 to time t4. Normally, the execution period of the simultaneous heating and defrosting operation (including the first operation and the second operation) is set to a predetermined time period. The execution period of the simultaneous heating and defrosting operation, namely, each of the time period from time t1 to time t2 and the time period from time t3 to time t4 is, for example, 13 minutes. Furthermore, normally, a continuous execution period of the heating operation from time at which the simultaneous heating and defrosting operation is ended to time at which a subsequent simultaneous heating and defrosting operation is started is set to a predetermined time period. The continuous execution period of the heating operation, that is, each of the time period from time t0 to time t1 and the time period from time t2 to time t3 is, for example, 20 minutes. In the case where the continuous execution period of the heating operation is set to 20 minutes and the execution period of the simultaneous heating and defrosting operation is set to 13 minutes, a repetition period of the heating operation and the simultaneous heating and defrosting operation is 33 minutes. The threshold fth is set equal to the operating frequency of the compressor 11 that is required to complete defrosting of the first outdoor heat exchanger 15*a* and the second outdoor heat exchanger 15*b* within the execution time period of one simultaneous heating and defrosting operation.

The operating frequency f1 of the compressor 11 during the heating operation satisfies fmax−f1≥fth. Therefore, during the simultaneous heating and defrosting operation, a heating capacity equivalent to the heating capacity during the heating operation and a defrosting capacity required to defrost the first outdoor heat exchanger 15*a* and the second outdoor heat exchanger 15*b* can be secured by the operation of the compressor 11 at the maximum operating frequency fmax or less. Therefore, in the case where fmax−f1≥fth is satisfied, the heating operation and the simultaneous heating and defrosting operation are alternately performed, whereby it is possible to defrost the first outdoor heat exchanger 15*a* and the second outdoor heat exchanger 15*b* while maintaining a required heating capacity. As a result, the heating can be continued for a long time.

FIG. 7 is a graph illustrating a comparative example of the operating frequency that varies with the passage of time in the case where the heating operation and the simultaneous heating and defrosting operation are alternately performed. In the example indicated in FIG. 7, fmax−f2≥fth is not satisfied, since the operating frequency f2 of the compressor 11 during the heating operation is greater than the operating frequency f1. Therefore, even when the compressor 11 operates at the maximum operating frequency fmax during the simultaneous heating and defrosting operation, the heating capacity equivalent to the heating capacity during the heating operation cannot be maintained, or defrosting of the first outdoor heat exchanger 15*a* and the second outdoor heat exchanger 15*b* cannot be completed within a determined time period.

FIG. 8 is a graph indicating an example of the operating frequency that varies with the passage of time in the case where the heating operation and the defrosting operation are alternately performed in the refrigeration cycle apparatus according to Embodiment 1. In the example indicated in FIG. 8, the heating operation in which the compressor 11 operates at the operating frequency f2 is performed during a time period from time t10 to time t11 and during a time period from time t12 to time t13. The defrosting operation in which the compressor 11 operates at the maximum operating frequency fmax is performed during a time period from time t11 to time t12 and during a time period from time t13 to time t14. Normally, the execution period of the defrosting operation is set to a predetermined time period. The execution period of the defrosting operation, that is, each of the time period from time t11 to time t12 and the time period from time t13 to time t14 is, for example, 3 minutes. Furthermore, normally, the continuous execution period of the heating operation from time at which the defrosting operation is ended to time when a subsequent defrosting operation is started is set to a predetermined time period. The continuous execution period of the heating operation, that is, each of the time period from time t10 to time t11 and the time period from time t12 to time t13 is, for example, 30 minutes. In the case where the continuous execution period of the heating operation is set to 30 minutes and the execution period of the defrosting operation is set to 3 minutes, a repetition period of the heating operation and the defrosting operation is 33 minutes.

In the example indicated in FIG. 8, the operating frequency f2 of the compressor 11 during the heating operation does not satisfy fmax−f2≥fth. In this case, even when the simultaneous heating and defrosting operation is performed after the heating operation, the heating capacity equivalent to the heating capacity during the heating operation cannot be maintained, or defrosting of the first outdoor heat exchanger 15*a* and the second outdoor heat exchanger 15*b* cannot be completed within a determined period. Therefore, in Embodiment 1, in the case where the operating frequency f2 of the compressor 11 during the heating operation does not satisfy fmax−f2≥fth, not the simultaneous heating and defrosting operation but the defrosting operation is performed after the heating operation. During the defrosting operation, the heating is temporarily interrupted, but the defrosting of the first outdoor heat exchanger 15*a* and the second outdoor heat exchanger 15*b* can be performed with a high defrosting capacity. Therefore, in the case where the defrosting operation is performed, the first outdoor heat exchanger 15*a* and the second outdoor heat exchanger 15*b* can be reliably defrosted in a short time period.

Figure 9:
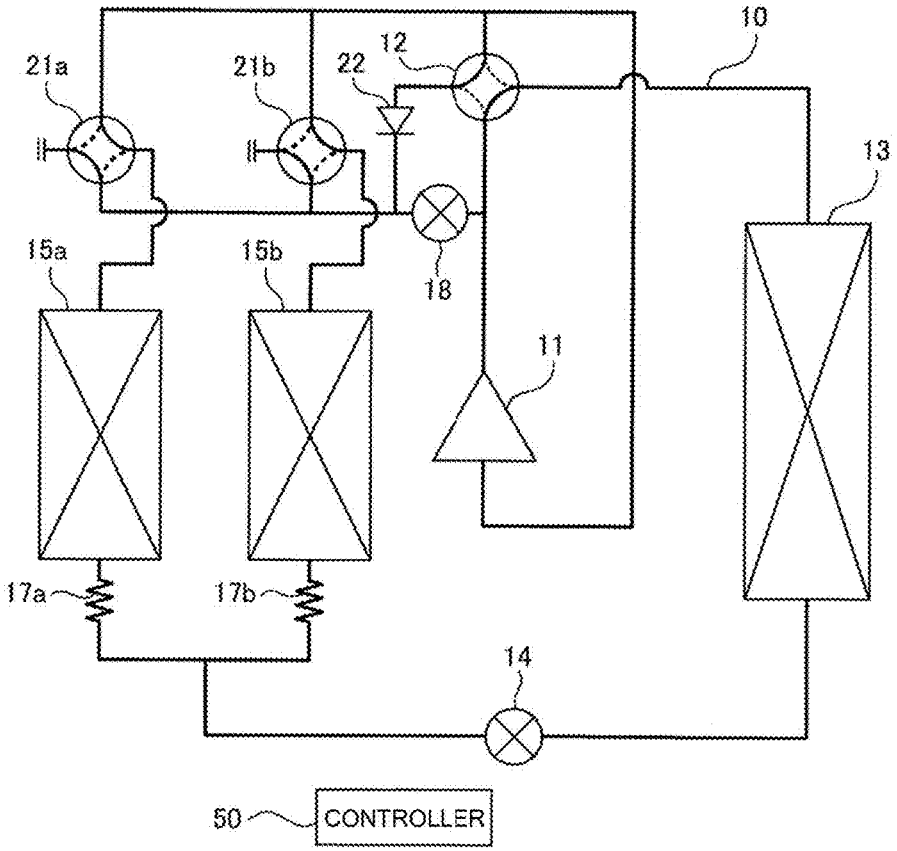
FIG. 9 is a refrigerant circuit diagram illustrating a modification of the configuration of the refrigeration cycle apparatus according to Embodiment 1 of the present disclosure.

FIG. 9 is a refrigerant circuit diagram illustrating a modification of the configuration of the refrigeration cycle apparatus according to Embodiment 1. As compared with the refrigerant circuit 10 as illustrated in FIG. 1, the refrigerant circuit 10 of the modification includes two four-way valves 21*a* and 21*b* and a check valve 22 in place of the second flow switching device 16. The four-way valves 21*a* and 21*b* are controlled by the controller 50. The refrigerant circuit 10 of the modification, as well as the refrigerant circuit 10 as illustrated in FIG. 1, is capable of performing at least the heating operation, the defrosting operation, and the simultaneous heating and defrosting operation, though the refrigerant circuit 10 of the modification is more complicated than the refrigerant circuit 10 as illustrated in FIG. 1. Embodiment 1 is also applicable to a refrigeration cycle apparatus provided with the refrigerant circuit 10 of the modification. In addition, Furthermore, Embodiment 1 is also applicable to a refrigeration cycle apparatus including a refrigerant circuit other than the refrigerant circuit 10 of the modification as long as the refrigerant circuit is capable of performing the heating operation in which the first outdoor heat exchanger 15*a* and the second outdoor heat exchanger 15*b* operate as evaporators and the indoor heat exchanger 13 operates as a condenser, the defrosting operation in which the first outdoor heat exchanger 15*a* and the second outdoor heat exchanger 15*b* operate as condensers, and the simultaneous heating and defrosting operation in which one of the first outdoor heat exchanger 15*a* and the second outdoor heat exchanger 15*b* operates as an evaporator and the other of the first outdoor heat exchanger 15*a* and the second outdoor heat exchanger 15*b* and the indoor heat exchanger 13 operate as condensers.

As described above, the refrigeration cycle apparatus according to Embodiment 1 includes the refrigerant circuit 10 that includes the compressor 11, the first outdoor heat exchanger 15*a*, the second outdoor heat exchanger 15*b*, and the indoor heat exchanger 13, and the controller 50 that controls the refrigerant circuit 10. The compressor 11 operates at the variable operating frequency that falls within in the preset operating frequency range. The refrigerant circuit 10 is capable of performing the heating operation in which the first outdoor heat exchanger 15*a* and the second outdoor heat exchanger 15*b* operate as evaporators and the indoor heat exchanger 13 operates as a condenser, the defrosting operation in which the first outdoor heat exchanger 15*a* and the second outdoor heat exchanger 15*b* operate as condensers, and the simultaneous heating and defrosting operation in which one of the first outdoor heat exchanger 15*a* and the second outdoor heat exchanger 15*b* operates as an evaporator and the other of the first outdoor heat exchanger 15*a* and the second outdoor heat exchanger 15*b* and the indoor heat exchanger 13 operate as condensers. The controller 50 can cause the simultaneous heating and defrosting operation to be performed after the heating operation in the case where the value obtained by subtracting the operating frequency f of the compressor 11 from the maximum operating frequency fmax that is the upper limit of the operating frequency range is greater than or equal to the threshold fth during the heating operation, and can also cause the defrosting operation to be performed after the heating operation in the case where the value obtained by subtracting the operating frequency f of the compressor 11 from the maximum operating frequency fmax is less than the threshold fth during the heating operation.

In the above configuration, in the case where the value (fmax−f) obtained by subtracting the operating frequency f during the heating operation from the maximum operating frequency fmax is greater than the threshold fth, that is, in the case where the heating load is small and a reserve capacity of the heating capacity is large, the simultaneous heating and defrosting operation is performed after the heating operation. In the simultaneous heating and defrosting operation in the case where the heating load is small, it is possible to complete the defrosting of the first outdoor heat exchanger 15*a* and the second outdoor heat exchanger 15*b* within the determined time while maintaining the heating capacity during the heating operation. Therefore, in the case where the heating load is small, it is possible to continue the heating for a long time by causing the heating operation and the simultaneous heating and defrosting operation to be alternately performed. In contrast, in the case where the value fmax−f is less than or equal to the threshold fth, that is, in the case where the heating load is large and the reserve capacity of the heating capacity is small, the defrosting operation is performed after the heating operation. As a result, in the case where the heating load is large, the first outdoor heat exchanger 15*a* and the second outdoor heat exchanger 15*b* can be reliably defrosted in a short time period by the defrosting operation. It is therefore possible to accurately determine which of the simultaneous heating and defrosting operation and the defrosting operation should be performed after the heating operation, based on the heating load. Thus, it is possible to further improve the average heating capacity per one cycle from completion of the defrosting to completion of subsequent defrosting which follows the heating operation. Thus, in the case where the refrigeration cycle apparatus is applied to an air-conditioning apparatus, it is possible to further improve indoor comfort.

In the refrigeration cycle apparatus according to Embodiment 1, in the case where the number N of times the simultaneous heating and defrosting operation is performed after last performance of the defrosting operation reaches the threshold number Nth, the controller 50 causes the defrosting operation to be performed regardless of the value obtained by subtracting the operating frequency f during the heating operation from the maximum operating frequency fmax.

In the above configuration, the defrosting operation can be periodically performed regardless of the heating load. Therefore, even if the defrosting of the first outdoor heat exchanger 15*a* and the second outdoor heat exchanger 15*b* is not completed by the simultaneous heating and defrosting operation, the frost remaining at the first outdoor heat exchanger 15*a* and the second outdoor heat exchanger 15*b* can be reliably melt by the defrosting operation.

Embodiment 2

Figure 10:
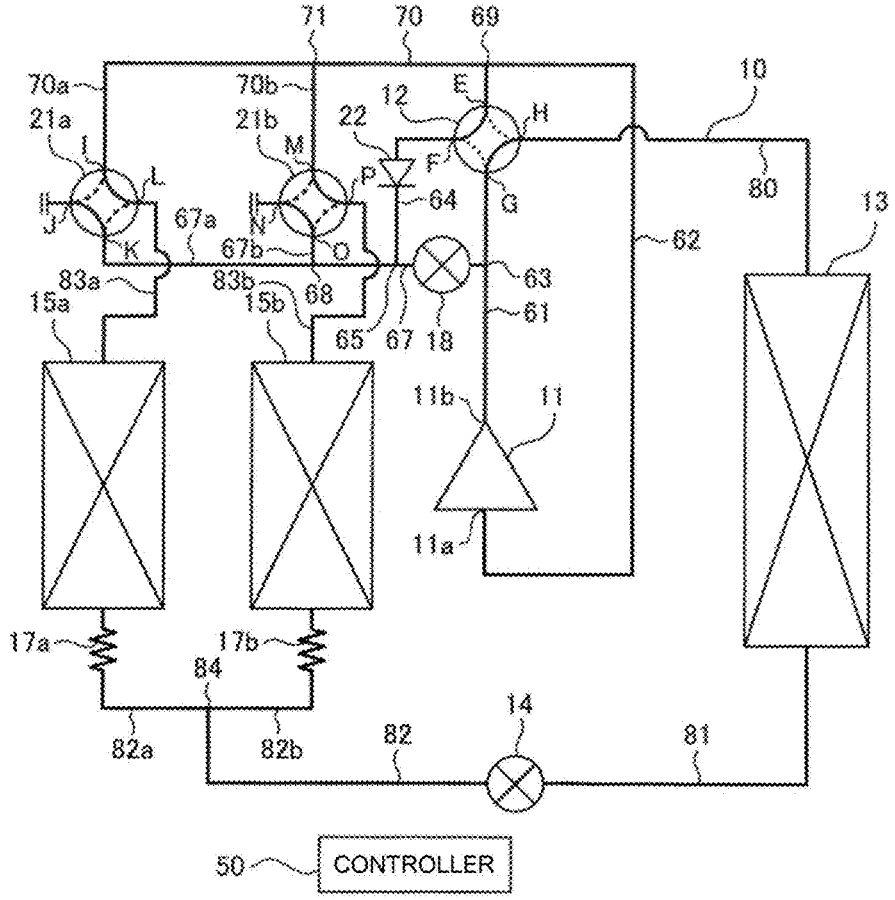
FIG. 10 is a refrigerant circuit diagram illustrating a configuration of a refrigeration cycle apparatus according to Embodiment 2 of the present disclosure.

A refrigeration cycle apparatus according to Embodiment 2 of the present disclosure is described. FIG. 10 is a refrigerant circuit diagram illustrating a configuration of the refrigeration cycle apparatus according to Embodiment 2. In Embodiment 2, an air-conditioning apparatus is provided by way of example as the refrigeration cycle apparatus. As illustrated in FIG. 10, the refrigeration cycle apparatus according to Embodiment 2 includes the refrigerant circuit 10 and the controller 50 that controls the refrigerant circuit 10. The refrigerant circuit 10 of Embodiment 2 has the same configuration as the refrigerant circuit 10 as illustrated in FIG. 9. The controller 50 of Embodiment 2 may be capable of performing a control similar to the control in Embodiment 1 as indicated in FIG. 5 or a control different from the control in Embodiment 1.

The refrigerant circuit 10 is capable of performing at least the heating operation, the defrosting operation, and the simultaneous heating and defrosting operation. The refrigerant circuit 10 may also be capable of performing the cooling operation. During the cooling operation, the first flow switching device 12, the four-way valve 21*a*, and the four-way valve 21*b* are set to be in respective states that are same as those during the defrosting operation.

The compressor 11 includes a suction port 11*a* from which the refrigerant is sucked and a discharge port 11*b* from which the compressed refrigerant is discharged. The suction port 11*a* is kept at a suction pressure, that is, a low pressure, and the discharge port 11*b* is kept at a discharge pressure, that is, a high pressure.

The four-way valve that is the first flow switching device 12 includes the four ports E, F, G, and H. In the following description, the port G, the port E, the port F, and the port H may be referred to as "first port G", "second port E", "third port F", and "fourth port H", respectively. The first port G is a high pressure port that is kept at a high pressure whichever of the heating operation, the defrosting operation, and the simultaneous heating and defrosting operation is performed. The second port E is a low pressure port that is kept at a low pressure whichever of the heating operation, the defrosting operation, and the simultaneous heating and defrosting operation is performed. As described above, the first flow switching device 12 can enter the first state indicated by solid lines in FIG. 10 and the second state indicated by dashed lines in FIG. 10. In the first state, the first port G and the fourth port H communicate with each other, and the second port E and the third port F communicate with each other. In the second state, the first port G and the third port F communicate with each other, and the second port E and the fourth port H communicate with each other. By the control by the controller 50, the first flow switching device 12 is set to be in the first state during the heating operation and the simultaneous heating and defrosting operation, and is set to be in the second state during the defrosting operation.

The four-way valve 21*a* includes four ports I, J, K, and L. In the following description, the port K, the port I, the port L, and the port J may be referred to as "fifth port K", "sixth port I", "seventh port L", and "eighth port J", respectively. The fifth port K is a high pressure port that is kept at a high pressure whichever of the heating operation, the defrosting operation, and the simultaneous heating and defrosting operation is performed. The sixth port I is a low pressure port that is kept at a low pressure whichever of the heating operation, the defrosting operation, and the simultaneous heating and defrosting operation is performed. The eighth port J is closed to prevent leakage of the refrigerant. The four-way valve 21*a* can enter a first state indicated by solid lines in FIG. 10 and a second state indicated by dashed lines in FIG. 10. In the first state, the fifth port K and the eighth port J communicate with each other, and the sixth port I and the seventh port L communicate with each other. In the second state, the fifth port K and the seventh port L communicate with each other, and the sixth port I and the eighth port J communicate with each other. By the control by the controller 50, the four-way valve 21*a* is set to be in the first state during the heating operation, is set to be in the second state during the defrosting operation, and is set to be in the first state or the second state as described below during the simultaneous heating and defrosting operation.

The four-way valve 21*b* includes four ports M, N, O, and P. In the following description, the port O, the port M, the port P, and the port N may be referred to as "fifth port O", "sixth port M", "seventh port P", and "eighth port N", respectively. The fifth port O is a high pressure port that is kept at a high pressure whichever of the heating operation, the defrosting operation, and the simultaneous heating and defrosting operation is performed. The sixth port M is a low pressure port that is kept at a low pressure whichever of the heating operation, the defrosting operation, and the simultaneous heating and defrosting operation is performed. The eighth port N is closed to prevent leakage of the refrigerant. The four-way valve 21*b* can enter a first state indicated by solid lines in FIG. 10 and a second state indicated by dashed lines in FIG. 10. In the first state, the fifth port O and the eighth port N communicate with each other, and the sixth port M and the seventh port P communicate with each other. In the second state, the fifth port I and the seventh port P communicate with each other, and the sixth port M and the eighth port N communicate with each other. By the control by the controller 50, the four-way valve 21*b* is set to be in the first state during the heating operation, is set to be in the second state during the defrosting operation, and is set to be in the first state or the second state as described below during the simultaneous heating and defrosting operation.

Each of the first flow switching device 12, the four-way valve 21*a*, and the four-way valve 21*b* is a differential pressure drive type four-way valve that is operated by the differential pressure between the discharge pressure and the suction pressure. Four-way valves having the same configuration can be used as the first flow switching device 12, the four-way valve 21*a*, and the four-way valve 21*b*.

The discharge port 11*b* of the compressor 11 and the first port G of the first flow switching device 12 are connected with each other by a discharge pipe 61. In the discharge pipe 61, the high-pressure refrigerant discharged from the discharge port 11*b* of the compressor 11 flows whichever of the heating operation, the defrosting operation, and the simultaneous heating and defrosting operation is performed. The suction port 11*a* of the compressor 11 and the second port E of the first flow switching device 12 are connected with each other by a suction pipe 62. In the suction pipe 62, the low-pressure refrigerant sucked into the suction port 11*a* of the compressor 11 flows whichever of the heating operation, the defrosting operation, and the simultaneous heating and defrosting operation is performed.

One of ends of a first high pressure pipe 67 is connected with a bifurcation 63 provided at an intermediate portion of the discharge pipe 61, and the other end of the first high pressure pipe 67 branches into a first high pressure pipe 67*a* and a first high pressure pipe 67*b* at a bifurcation 68. The first high pressure pipe 67*a* is connected with the fifth high pressure port K of the four-way valve 21*a*. The first high pressure pipe 67*b* is connected with the fifth high pressure port O of the four-way valve 21*b*.

Another bifurcation 65 is provided between the bifurcation 63 and the bifurcation 68 of the first high pressure pipe 67. The bifurcation 65 of the first high pressure pipe 67 and the third port F of the first flow switching device 12 are connected by a second high pressure pipe 64.

The bypass expansion valve 18 is provided as a first valve at part of the first high pressure pipe 67 that is located between the bifurcation 63 and the bifurcation 65. The first valve is an on-off valve that is opened and closed by the control by the controller 50. As the first valve, a solenoid valve or an electric valve can be used in addition to the electronic expansion valve. The first valve also has a function to reduce the pressure of the refrigerant. The operation of the first valve will be described below.

At the second high pressure pipe 64, the check valve 22 is provided as a second valve. The check valve 22 allows the refrigerant to flow in a direction from the third port F of the first flow switching device 12 toward the first high pressure pipe 67, and blocks the flow of the refrigerant in a direction from the first high pressure pipe 67 toward the third port F. As the second valve, an on-off valve, such as a solenoid valve and a motor valve, which is opened and closed by the control by the controller 50, can also be used. The operation of the second valve in the case where the open-close valve is used as the second valve will be described below.

One of ends of a low pressure pipe 70 is connected with a bifurcation 69 provided at an intermediate portion of the suction pipe 62, and the other end of the low pressure pipe 70 branches into a low pressure pipe 70*a* and a low pressure pipe 70*b* at a bifurcation 71. The low pressure pipe 70*a* is connected with the sixth low pressure port I of the four-way valve 21*a*. The low pressure pipe 70*b* is connected with the sixth low pressure port M of the four-way valve 21*b*.

The fourth port H of the first flow switching device 12 is connected with one of inflow/outflow ports of the indoor heat exchanger 13 by a refrigerant pipe 80. Part of the refrigerant pipe 80 is an extension pipe that connects the outdoor unit and the indoor unit. At part of the refrigerant pipe 80 that is located closer to the outdoor unit than the extension pipe, a stop valve not illustrated is provided.

The other inflow/outflow port of the indoor heat exchanger 13 is connected with one of inflow/outflow ports of the expansion valve 14 by a refrigerant pipe 81. Part of the refrigerant pipe 81 is an extension pipe that connects the outdoor unit and the indoor unit. At part of the refrigerant pipe 81 that is located closer to the outdoor unit than the extension pipe, a stop valve not illustrated is provided.

With the other inflow/outflow port of the expansion valve 14, one of ends of a refrigerant pipe 82 is connected. The other end of the refrigerant pipe 82 branches into a refrigerant pipe 82*a* and a refrigerant pipe 82*b* at a bifurcation 84. At the refrigerant pipe 82*a*, a pressure-reducing device such as the capillary tube 17*a* is provided. The refrigerant pipe 82*a* is connected with one of inflow/outflow ports of the first outdoor heat exchanger 15*a*. At the refrigerant pipe 82*b*, a pressure-reducing device such as the capillary tube 17*b* is provided. The refrigerant pipe 82*b* is connected with one of inflow/outflow ports of the second outdoor heat exchanger 15*b*. That is, the other inflow/outflow port of the expansion valve 14 is connected with the above one of the inflow/outflow ports of the first outdoor heat exchanger 15*a* and the above one of the inflow/outflow ports of the second outdoor heat exchanger 15*b* by the refrigerant pipe 82. Furthermore, the above inflow/outflow port of the first outdoor heat exchanger 15*a* is connected with the above inflow/outflow port of the second outdoor heat exchanger 15*b* by the refrigerant pipe 82*a* and the refrigerant pipe 82*b*.

The other inflow/outflow port of the first outdoor heat exchanger 15*a* is connected with the seventh port L of the four-way valve 21*a* by a refrigerant pipe 83*a*. The other inflow/outflow port of the second outdoor heat exchanger 15*b* is connected with the seventh port P of the four-way valve 21*b* by a refrigerant pipe 83*b*. At least during the heating operation and the defrosting operation, in the refrigerant circuit 10, the first outdoor heat exchanger 15*a* and the second outdoor heat exchanger 15*b* are connected parallel to each other.

Figure 11:
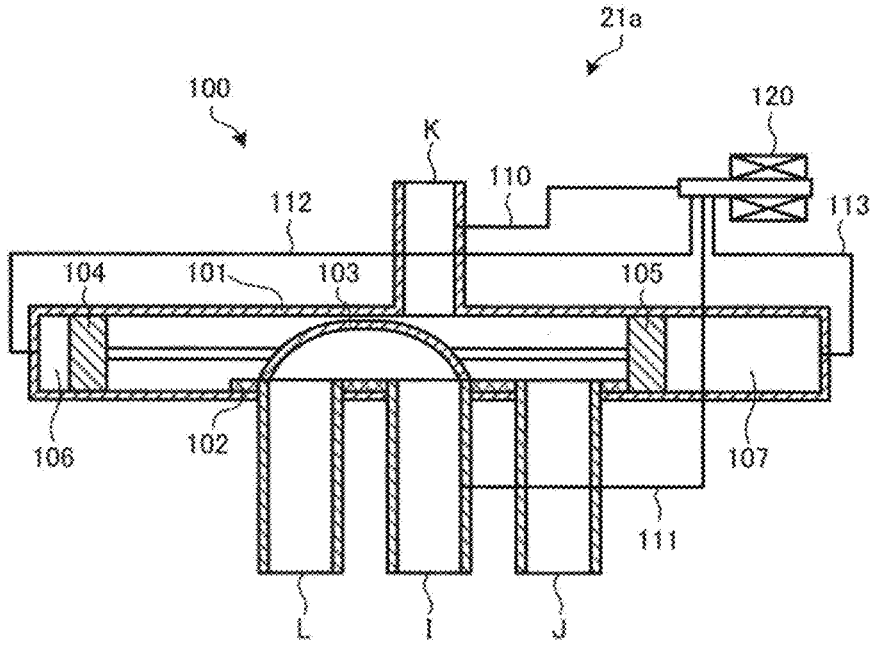
FIG. 11 is a sectional view illustrating a schematic configuration of a four-way valve 21*a* of the refrigeration cycle apparatus according to Embodiment 2 of the present disclosure.

FIG. 11 is a sectional view illustrating a schematic configuration of the four-way valve 21*a* of the refrigeration cycle apparatus according to Embodiment 2. As illustrated in FIG. 11, the four-way valve 21*a* includes a valve main body 100 and a pilot solenoid valve 120. The four-way valve 21*a* is a differential pressure drive type four-way valve.

The valve main body 100 includes a cylinder 101, a slide table 102 provided at part of an inner wall of the cylinder 101, and a slide valve 103 that is slid over the slide table 102 along a center axis direction of the cylinder 101. The sixth port I that is a low pressure port is provided at a center of the slide table 102 in the center axial direction of the cylinder 101. The seventh port L and the eighth port J are provided on opposite sides with respect to the sixth port I in the center axis direction of the cylinder 101. The fifth port K that is a high pressure port is provided opposite to the sixth port I with respect to the center axis of the cylinder 101.

The slide valve 103 is formed in the shape of a dome that is opened toward the slide table 102. A piston 104 coupled to the slide valve 103 is provided on one end side of the slide valve 103 in the center axis direction of the cylinder 101. A first chamber 106 is provided between one end of the cylinder 101 and the piston 104. A piston 105 coupled to the slide valve 103 is provided on the other end side of the slide valve 103 in the center axis direction of the cylinder 101, A second chamber 107 is provided between the other end of the cylinder 101 and the piston 105. The pistons 104 and 105 are provided slidable along an inner wall surface of the cylinder 101. The pistons 104 and 105 are moved together with the slide valve 103 in the center axis direction of the cylinder 101.

The pilot solenoid valve 120 is connected with the valve main body 100 by four pilot pipes 110, 111, 112, and 113. The pilot pipe 110 is connected with the fifth port K of the valve main body 100. The pilot pipe 111 is connected with the sixth port I of the valve main body 100. The pilot pipe 112 is connected with the first chamber 106 of the valve main body 100. The pilot pipe 113 is connected with the second chamber 107 of the valve main body 100.

The state of the pilot solenoid valve 120 is switched to a first state or a second state by the control by the controller 50. In the first state of the pilot solenoid valve 120, the pilot pipe 110 and the pilot pipe 113 communicate with each other in the pilot solenoid valve 120, and the pilot pipe 111 and the pilot pipe 112 communicate with each other in the pilot solenoid valve 120. Therefore, in the first state, the fifth port K and the second chamber 107 communicate with each other, whereby the pressure of the second chamber 107 increases to a high value, and the sixth port I and the first chamber 106 communicate with each other, whereby the pressure of the first chamber 106 decreases to a low value. The slide valve 103 is moved toward the first chamber 106 by the pressure difference between the first chamber 106 and the second chamber 107, and is thus made to be in a state illustrated in FIG. 11. As a result, the sixth port I and the seventh port L communicate with each other, and the fifth port K and the eighth port J communicate with each other.

In the second state of the pilot solenoid valve 120, the pilot pipe 110 and the pilot pipe 112 communicate with each other in the pilot solenoid valve 120, and the pilot pipe 111 and the pilot pipe 113 communicate with each other in the pilot solenoid valve 120. Therefore, in the second state, the fifth port K and the first chamber 106 communicate with each other, whereby the pressure of the first chamber 106 increases to be high, the sixth port I and the second chamber 107 communicate with each other, whereby the pressure of the second chamber 107 decreases to be low. The slide valve 103 is moved toward the second chamber 107 by the pressure difference between the first chamber 106 and the second chamber 107. As a result, the sixth port I and the eighth port J communicate with each other, and the fifth port K and the seventh port L communicate with each other.

In either the first state or the second state, since the pressure of the fifth port K is higher than the pressure of the sixth port I, the slide valve 103 is pressed against the slide table 102 by the pressure difference, thereby reducing leakage of the refrigerant at the slide valve 103.

Although it is not illustrated or described, the four-way valve 21*b* and the first flow switching device 12 each have a configuration similar to the configuration of the four-way valve 21*a*.

Figure 12:
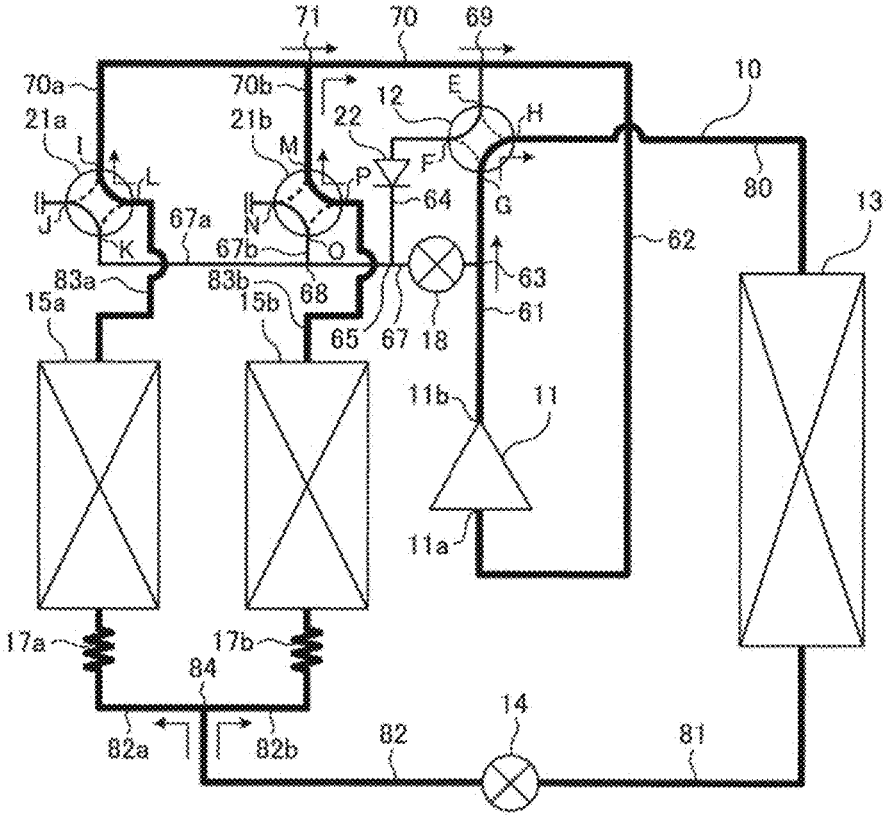
FIG. 12 is a diagram illustrating a state of the refrigeration cycle apparatus according to Embodiment 2 of the present disclosure during the heating operation.

Next, the operation of the refrigeration cycle apparatus during the heating operation will be described. FIG. 12 is a diagram illustrating the state of the refrigeration cycle apparatus according to Embodiment 2 during the heating operation. As illustrated in FIG. 12, during the heating operation, the first flow switching device 12 is set to be in the first state in which the first port G and the fourth port H communicate with each other and the second port E and the third port F communicate with each other. The four-way valve 21*a* is set to be in the first state in which the fifth port K and the eighth port J communicate with each other and the sixth port I and the seventh port L communicate with each other. The four-way valve 21*b* is set to be in the first state in which the fifth port O and the eighth port N communicate with each other and the sixth port M and the seventh port P communicate with each other.

The bypass expansion valve 18, that is, the first valve, is set to be in the opened state. When the bypass expansion valve 18 is set to be in the opened state, the pressure of the fifth port K of the four-way valve 21*a* and the pressure of the fifth port O of the four-way valve 21*b* are kept high or intermediate. The intermediate pressure is a pressure higher than the suction pressure of the compressor 11 and lower than the discharge pressure of the compressor 11. When the bypass expansion valve 18 is set to in the opened state, a terminal side of the first high pressure pipe 67 is closed by the eighth port J of the four-way valve 21*a* and the eighth port N of the four-way valve 21*b*, and thus the refrigerant does not flow out from the other ports of the four-way valve 21*a* and the four-way valve 21*b*. The bypass expansion valve 18 may be set to be in the closed state. The pressure of the sixth port I of the four-way valve 21*a* and the pressure of the sixth port M of the four-way valve 21*b* are kept low. Therefore, even when the bypass expansion valve 18 is set to be in the closed state, the pressure of the fifth port K of the four-way valve 21*a* is kept higher than the pressure of the sixth port I of the four-way valve 21*a*, and the pressure of the fifth port O of the four-way valve 21*b* is kept higher than the pressure of the sixth port M of the four-way valve 21*b*.

The flow of the refrigerant in a direction from the first high pressure pipe 67 toward the third port F of the first flow switching device 12 is blocked by the check valve 22. In the case where an on-off valve is used as the second valve in place of the check valve 22, the on-off valve is set to be in the closed state. As a result, the flow of the refrigerant in the direction from the first high pressure pipe 67 toward the third port F of the first flow switching device 12 is blocked by the on-off valve.

The high-pressure gas refrigerant discharged from the compressor 11 flows into the indoor heat exchanger 13 through the discharge pipe 61, the first flow switching device 12, and the refrigerant pipe 80. During the heating operation, the indoor heat exchanger 13 operates as a condenser. More specifically, at the indoor heat exchanger 13 the refrigerant that flows in the indoor heat exchanger 13 and indoor air sent by the indoor fan exchange heat with each other, and condensation heat of the refrigerant is transferred to the indoor air. Therefore, the gas refrigerant that has flowed into the indoor heat exchanger 13 is condensed to change into high-pressure liquid refrigerant. In addition, the indoor air sent by the indoor fan is heated by the heat transferred from the refrigerant.

The liquid refrigerant that has flowed out of the indoor heat exchanger 13 flows into the expansion valve 14 through the refrigerant pipe 81. The liquid refrigerant that has flowed into the expansion valve 14 is reduced in pressure to change into low-pressure two-phase refrigerant. After flowing out of the expansion valve 14, the two-phase refrigerant flows through the refrigerant pipe 82, and then branches off to flow into the refrigerant pipe 82*a* and the refrigerant pipe 82*b*. The two-phase refrigerant that has flowed into the refrigerant pipe 82*a* is further reduced in pressure in the capillary tube 17*a*, and then flows into the first outdoor heat exchanger 15*a*. The two-phase refrigerant that has flowed into the refrigerant pipe 82*b* is further reduced in pressure in the capillary tube 17*b*, and then flows into the second outdoor heat exchanger 15*b*.

During the heating operation, the first outdoor heat exchanger 15*a* and the second outdoor heat exchanger 15*b* both operate as evaporators. More specifically, at each of the first outdoor heat exchanger 15*a* and the second outdoor heat exchanger 15*b*, the refrigerant that flows in each outdoor heat exchanger and outdoor air sent by the outdoor fan exchange heat with each other, and evaporation heat for the refrigerant is absorbed from the outdoor air. Therefore, the two-phase refrigerant that has flowed into each of the first outdoor heat exchanger 15*a* and the second outdoor heat exchanger 15*b* is evaporated to change into low-pressure gas refrigerant.

After flowing out of the first outdoor heat exchanger 15*a*, the gas refrigerant is sucked into the compressor 11 through the refrigerant pipe 83*a*, the four-way valve 21*a*, the low pressure pipe 70*a*, the low pressure pipe 70, and the suction pipe 62. The gas After flowing out of the second outdoor heat exchanger 15*b*, the gas refrigerant flows through the refrigerant pipe 83*b*, the four-way valve 21*b*, and the low pressure pipe 70*b*, then joins the gas refrigerant that has flowed out of the first outdoor heat exchanger 15*a*, and the resultant gas refrigerant is sucked into the compressor 11. That is, the gas refrigerant that has flowed out of each of the first outdoor heat exchanger 15*a* and the second outdoor heat exchanger 15*b* is sucked into the compressor 11 without flowing through the first flow switching device 12. The gas refrigerant sucked into the compressor 11 is compressed into high-pressure gas refrigerant. During the heating operation, the above cycle is continuously repeated.

During the heating operation, the first port G of the first flow switching device 12, the fifth port K of the four-way valve 21*a*, and the fifth port O of the four-way valve 21*b* are each kept at a high pressure or an intermediate pressure. Furthermore, during the heating operation, the second port E of the first flow switching device 12, the sixth port I of the four-way valve 21*a*, and the sixth port M of the four-way valve 21*b* are each kept at a low pressure.

Figure 13:
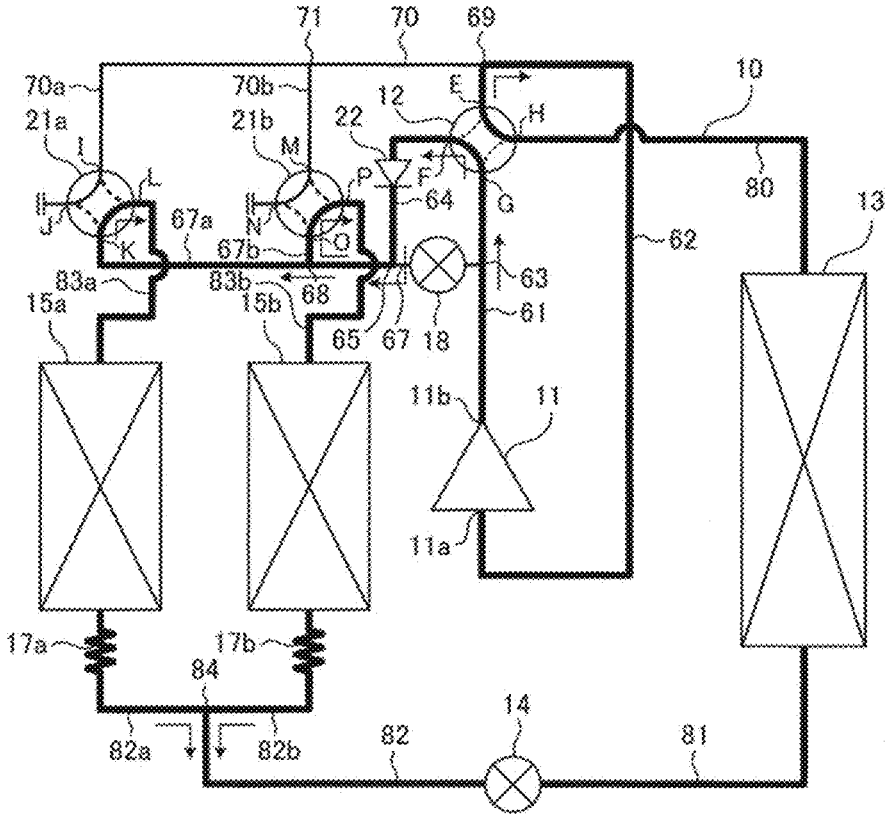
FIG. 13 is a diagram illustrating the state of the refrigeration cycle apparatus according to Embodiment 2 of the present disclosure during the defrosting operation.

Next, the operation of the refrigeration cycle apparatus during the defrosting operation will be described. FIG. 13 is a diagram illustrating the state of the refrigeration cycle apparatus according to Embodiment 2 during the defrosting operation. As illustrated in FIG. 13, during the defrosting operation, the first flow switching device 12 is set to be in the second state in which the first port G and the third port F communicate with each other and the second port E and the fourth port H communicate with each other. The four-way valve 21*a* is set to be in the second state in which the fifth port K and the seventh port L communicate with each other and the sixth port I and the eight port J communicate with each other. The four-way valve 21*b* is set to be in the second state in which the fifth port O and the seventh port P communicate with each other and the sixth port M and the eighth port N communicate with each other.

The bypass expansion valve 18 that is the first valve is set to be, for example, in the closed state. The flow of the refrigerant in a direction from the third port F of the first flow switching device 12 toward the first high pressure pipe 67 is allowed by the check valve 22. In the case where an on-off valve is used as the second valve in place of the check valve 22 the on-off valve is set to be in the opened state. As a result, the flow of the refrigerant in the direction from the third port F of the first flow switching device 12 toward the first high pressure pipe 67 is allowed by the on-off valve.

The high-pressure gas refrigerant discharged from the compressor 11 flows through the discharge pipe 61, the first flow switching device 12, the second high pressure pipe 64, and the first high pressure pipe 67, and branches off to flows into the first high pressure pipe 67*a* and the first high pressure pipe 67*b*. The gas refrigerant that has flowed into the first high pressure pipe 67*a* flows into the first outdoor heat exchanger 15*a* through the four-way valve 21*a* and the refrigerant pipe 83*a*. The gas refrigerant that has flowed into the first high pressure pipe 67*b* flows into the second outdoor heat exchanger 15*b* through the four-way valve 21*b* and the refrigerant pipe 83*b*. During the defrosting operation, the first outdoor heat exchanger 15*a* and the second outdoor heat exchanger 15*b* both operate as condensers. More specifically, the frost adhering to the first outdoor heat exchanger 15*a* and the second outdoor heat exchanger 15*b* is melted by heat transferred from the refrigerant that flows in the first outdoor heat exchanger 15*a* and the second outdoor heat exchanger 15*b*. As a result, the first outdoor heat exchanger 15*a* and the second outdoor heat exchanger 15*b* are defrosted. In addition, the gas refrigerant that has flowed into each of the first outdoor heat exchanger 15*a* and the second outdoor heat exchanger 15*b* is condensed to change into liquid refrigerant.

The liquid refrigerant that has flowed out of the first outdoor heat exchanger 15*a* is reduced in pressure in the capillary tube 17*a*, and then flows into the expansion valve 14 through the refrigerant pipe 82*a* and the refrigerant pipe 82. The liquid refrigerant that has flowed out of the second outdoor heat exchanger 15*b* is reduced in pressure in the capillary tube 17*b*, passes through the refrigerant pipe 82*b*, and then joins the liquid refrigerant that has flowed out of the first outdoor heat exchanger 15*a*, and the resultant refrigerant flows into the expansion valve 14. The liquid refrigerant that has flowed into the expansion valve 14 is reduced in pressure to change into low-pressure two-phase refrigerant. After flowing out of the expansion valve 14, the two-phase refrigerant flows into the indoor heat exchanger 13 through the refrigerant pipe 81. During the defrosting operation, the indoor heat exchanger 13 operates as an evaporator. More specifically, in the indoor heat exchanger 13, evaporation heat for the refrigerant that flows in the indoor heat exchanger 13 is absorbed from the indoor air. Therefore, the two-phase refrigerant that has flowed into the indoor heat exchanger 13 is evaporated to change into low-pressure gas refrigerant. The gas refrigerant that has flowed out of the indoor heat exchanger 13 is sucked into the compressor 11 through the refrigerant pipe 80, the first flow switching device 12, and the suction pipe 62. The gas refrigerant sucked into the compressor 11 is compressed into high-pressure gas refrigerant. During the defrosting operation, the above cycle is continuously repeated.

During the defrosting operation, the first port G of the first flow switching device 12, the fifth port K of the four-way valve 21*a*, and the fifth port O of the four-way valve 21*b* are each kept at a high pressure. Furthermore, during the defrosting operation, the second port E of the first flow switching device 12, the sixth port I of the four-way valve 21*a*, and the sixth port M of the four-way valve 21*b* are each kept at a low pressure.

Figure 14:
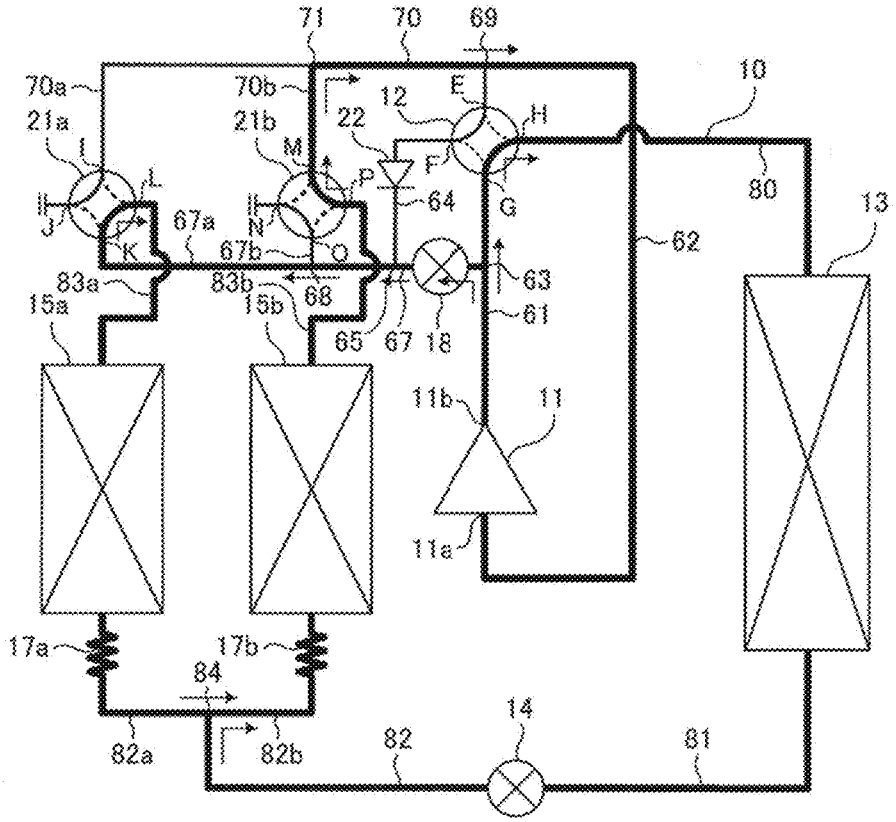
FIG. 14 is a diagram illustrating the state of the refrigeration cycle apparatus according to Embodiment 2 of the present disclosure during the simultaneous heating and defrosting operation.

Next, the operation of the refrigeration cycle apparatus during the simultaneous heating and defrosting operation will be described. FIG. 14 is a diagram illustrating the state of the refrigeration cycle apparatus according to Embodiment 2 during the simultaneous heating and defrosting operation. The simultaneous heating and defrosting operation includes the first operation and the second operation. During the first operation, the first outdoor heat exchanger 15*a* and the indoor heat exchanger 13 operate as condensers, and the second outdoor heat exchanger 15*b* operates as an evaporator. As a result, the heating is continued while the first outdoor heat exchanger 15*a* is being defrosted. During the second operation, the second outdoor heat exchanger 15*b* and the indoor heat exchanger 13 operate as condensers, and the first outdoor heat exchanger 15*a* operates as an evaporator. As a result, the heating is continued while the second outdoor heat exchanger 15*b* is being defrosted. FIG. 14 illustrates the operation of the refrigeration cycle apparatus during the first operation of the simultaneous heating and defrosting operation.

As illustrated in FIG. 14, during the first operation, the first flow switching device 12 is set to be in the first state in which the first port G and the fourth port H communicate with each other and the second port E and the third port F communicate with each other. The four-way valve 21*a* is set to be in the second state in which the fifth port K and the seventh port L communicate with each other and the sixth port I and the eighth port J communicate with each other. The four-way valve 21*b* is set to be in the first state in which the fifth port O and the eighth port N communicate with each other and the sixth port M and the seventh port P communicate with each other.

The bypass expansion valve 18 that is the first valve is set to in the opened state. The flow of the refrigerant in the direction from the first high pressure pipe 67 toward the third port F of the first flow switching device 12 is blocked by the check valve 22. In the case where an on-off valve is used as the second valve in place of the check valve 22, the on-off valve is set to the closed state. As a result, the flow of the refrigerant in the direction from the first high pressure pipe 67 toward the third port F of the first flow switching device 12 is blocked by the on-off valve.

The high-pressure gas refrigerant discharged from the compressor 11 flows through the discharge pipe 61 and branches off such that part of the high-pressure gas refrigerant flows into the first high pressure pipe 67. The pressure of the gas refrigerant that has flowed into the first high pressure pipe 67 is reduced to an intermediate pressure in the bypass expansion valve 18, and then the gas refrigerant flows into the first outdoor heat exchanger 15*a* through the first high pressure pipe 67*a*, the four-way valve 21*a*, and the refrigerant pipe 83*a*. In the first outdoor heat exchanger 15*a*, frost adhering thereto is melted by the heat transferred from the refrigerant that flowing in the first outdoor heat exchanger 15*a*. As a result, the first outdoor heat exchanger 15*a* is defrosted. The gas refrigerant that has flowed into the first outdoor heat exchanger 15*a* is condensed to change into intermediate-pressure liquid refrigerant or two-phase refrigerant, and the intermediate-pressure liquid refrigerant or two-phase refrigerant flows out of the first outdoor heat exchanger 15*a* and is reduced in pressure in the capillary tube 17*a*.

Of the high-pressure gas refrigerant discharged from the compressor 11, the gas refrigerant other than the gas refrigerant that has flowed into the first high pressure pipe 67 flows into the indoor heat exchanger 13 through the first flow switching device 12 and the refrigerant pipe 80. At the indoor heat exchanger 13, the refrigerant that flows in the indoor heat exchanger 13 and the indoor air sent by the indoor fan exchange heat with each other, and condensation heat of the refrigerant is transferred to the indoor air. As a result, the gas refrigerant that has flowed into the indoor heat exchanger 13 is condensed to change into high-pressure liquid refrigerant. In addition, the indoor air sent by the indoor fan is heated by the heat transferred from the refrigerant.

The liquid refrigerant that has flowed out of the indoor heat exchanger 13 flows into the expansion valve 14 through the refrigerant pipe 81. The liquid refrigerant that flowed into the expansion valve 14 is reduced in pressure to change into low-pressure two-phase refrigerant. The two-phase refrigerant that has flowed out of the expansion valve 14 passes through the refrigerant pipe 82, and joins the liquid refrigerant or the two-phase refrigerant reduced in pressure in the capillary tube 17*a*. The resultant refrigerant is then further reduced in pressure in the capillary tube 17*b*, and flows into the second outdoor heat exchanger 15*b*. In the second outdoor heat exchanger 15*b*, the refrigerant that flows in the second outdoor heat exchanger 15*b* and the outdoor air sent by the outdoor fan exchange heat with each other, and evaporation heat for the refrigerant is absorbed from the outdoor air. As a result, the two-phase refrigerant that has flowed into the second outdoor heat exchanger 15*b* is evaporated to change into low-pressure gas refrigerant. After flowing out of the second outdoor heat exchanger 15*b*, the gas refrigerant is sucked into the compressor 11 through the refrigerant pipe 83*b*, the four-way valve 21*b*, the low pressure pipe 70*b*, the low pressure pipe 70, and the suction pipe 62. That is, the gas refrigerant that has flowed out of the second outdoor heat exchanger 15*b* is sucked into the compressor 11 without flowing through the first flow switching device 12. The gas refrigerant sucked into the compressor 11 is compressed into high-pressure gas refrigerant. During the first operation of the simultaneous heating and defrosting operation, the above cycle is continuously repeated. As a result, the heating is continued while the first outdoor heat exchanger 15*a* is being defrosted.

During the first operation of the simultaneous heating and defrosting operation, the first port G of the first flow switching device 12, the fifth port K of the four-way valve 21*a*, and the fifth port O of the four-way valve 21*b* are each kept at a high pressure or an intermediate pressure. Furthermore, during the first operation, the second port E of the first flow switching device 12, the sixth port I of the four-way valve 21*a*, and the sixth port M of the four-way valve 21*b* are each kept at a low pressure.

Although it is not illustrated, during the second operation of the simultaneous heating and defrosting operation, the four-way valve 21*a* is set to be in the first state and the four-way valve 21*b* is set to be in the second state, contrary to the first operation. The first flow switching device 12 and the bypass expansion valve 18 are set to be in respective states, which are same as those during the first operation. As a result, during the second operation, the heating is continued while the second outdoor heat exchanger 15*b* is being defrosted. During the second operation, the first port G of the first flow switching device 12, the fifth port K of the four-way valve 21*a*, and the fifth port O of the four-way valve 21*b* are each kept at a high pressure or an intermediate pressure. Furthermore, during the second operation, the second port E of the first flow switching device 12, the sixth port I of the four-way valve 21*a*, and the sixth port M of the four-way valve 21*b* are each kept at a low pressure.

As described above, the refrigeration cycle apparatus according to Embodiment 2 includes the first flow switching device 12, the four-way valve 21*a*, the four-way valve 21*b*, the compressor 11, the discharge pipe 61, the suction pipe 62, the first high pressure pipe 67, the second high pressure pipe 64, the bypass expansion valve 18, the check valve 22, the low pressure pipe 70, the first outdoor heat exchanger 15*a*, the second outdoor heat exchanger 15*b*, and the indoor heat exchanger 13. The first flow switching device 12 has the first port G, the second port E, the third port F, and the fourth port H. The four-way valve 21*a* has the fifth port K, the sixth port I, the seventh port L, and the closed eighth port J. The four-way valve 21*b* has the fifth port O, the sixth port M, the seventh port P, and the closed eighth port N. The compressor 11 has the suction port 11*a* from which the refrigerant is sucked, and the discharge port 11*b* from which the refrigerant is discharged. The discharge pipe 61 connects the discharge port 11*b* of the compressor 11 and the first port G of the first flow switching device 12. The suction pipe 62 connects the suction port 11*a* of the compressor 11 and the second port E of the first flow switching device 12. The first high pressure pipe 67 connects the discharge pipe 61 and the fifth port K of the four-way valve 21*a* and the fifth port O of the four-way valve 21*b*. The second high pressure pipe 64 connects the third port F of the first flow switching device 12 and the bifurcation 65 provided at the first high pressure pipe 67. The bypass expansion valve 18 is provided at part of the first high pressure pipe 67 that is located between the discharge pipe 61 and the bifurcation 65. The check valve 22 is provided at the second high pressure pipe 64. The low pressure pipe 70 connects the suction pipe 62 and the sixth port I of the four-way valve 21*a* and the sixth port M of the four-way valve 21*b*. The first outdoor heat exchanger 15*a* is connected with the seventh port L of the four-way valve 21*a*. The second outdoor heat exchanger 15*b* is connected with the seventh port P of the four-way valve 21*b*. The indoor heat exchanger 29 is connected with the fourth port H of the first flow switching device 12. The first flow switching device 12 is an example of a first four-way valve. The four-way valve 21*a* is an example of a second four-way valve. The four-way valve 21*b* is an example of a third four-way valve. The bypass expansion valve 18 is an example of a first valve. The check valve 22 is an example of a second valve.

In the above configuration, whichever of the heating operation, the defrosting operation, and the simultaneous heating and defrosting operation is performed, the pressure of the fifth port K of the four-way valve 21*a* is kept higher than the pressure of the sixth port I of the four-way valve 21*a*, and the pressure of the fifth port O of the four-way valve 21*b* is kept higher than the pressure of the sixth port M of the four-way valve 21*b*. Therefore, as each of the four-way valve 21*a* and the four-way valve 21*b*, a differential pressure drive type four-way valve can be used. Therefore, in Embodiment 2, the configuration of the refrigerant circuit 10 that can perform the heating operation, the defrosting operation, and the simultaneous heating and defrosting operation can be further simplified.

In addition, the refrigeration cycle apparatus according to Embodiment 2 is capable of performing the heating operation in which the first outdoor heat exchanger 15*a* and the second outdoor heat exchanger 15*b* operate as evaporators and the indoor heat exchanger 13 operates as a condenser, the defrosting operation in which the first outdoor heat exchanger 15*a* and the second outdoor heat exchanger 15*b* operate as condensers, and the simultaneous heating and defrosting operation in which one of the first outdoor heat exchanger 15*a* and the second outdoor heat exchanger 15*b* operates as an evaporator and the other of the first outdoor heat exchanger 15*a* and the second outdoor heat exchanger 15*b* and the indoor heat exchanger 13 operates as condensers. During the heating operation, the first flow switching device 12 is set to cause the first port G and the fourth port H to communicate with each other and to cause the second port E and the third port F to communicate with each other; the four-way valve 21*a* is set to cause the fifth port K and the eighth port J to communicate with each other and to cause the sixth port I and the seventh port L to communicate with each other; the four-way valve 21*b* is set to cause the fifth port O and the eighth port N to communicate with each other and to cause the sixth port M and the seventh port P to communicate with each other; and the check valve 22 blocks the flow of the refrigerant from the bifurcation 65 toward the third port F. During the defrosting operation, the first flow switching device 12 is set to make the first port G and the third port F communicate with each other and to make the second port E and the fourth port H communicate with each other; the four-way valve 21*a* is set to cause the fifth port K and the seventh port L to communicate with each other and to cause the sixth port I and the eighth port J to communicate with each other; the four-way valve 21*b* is set to cause the fifth port O and the seventh port P to communicate with each other and to cause the sixth port M and the eighth port N to communicate with each other; and the check valve 22 allows the flow of the refrigerant from the third port F toward the bifurcation 65. During the simultaneous heating and defrosting operation, the first flow switching device 12 is set to cause the first port G and the fourth port H to communicate with each other and to cause the second port E and the third port F to communicate with each other; the four-way valve 21*a* is set to cause the fifth port K and the seventh port L to communicate with each other and to cause the sixth port I and the eighth port J to communicate with each other; the four-way valve 21*b* is set to cause the fifth port O and the eighth port N to communicate with each other and to cause the sixth port M and the seventh port P to communicate with each other; the bypass expansion valve 18 is set to be in the opened state; and the check valve 22 blocks the flow of the refrigerant from the bifurcation 65 toward the third port F.

Embodiments 1 and 2 as described above can be put to practical use in combination.

REFERENCE SIGNS LIST

10 refrigerant circuit 11 compressor 11*a* suction port 11*b* discharge port 12 first flow switching device 13 indoor heat exchanger 14 expansion valve 15*a* first outdoor heat exchanger 15*b* second outdoor heat exchanger

16 second flow switching device 17*a*, 17*b* capillary tube 18 bypass expansion valve 21*a*, 21*b* four-way valve 22 check valve 30, 31, 32, 33, 33*a*, 33*b*, 34, 35, 36, 37, 38 pipe 50 controller 61 discharge pipe 62 suction pipe 63, 65, 68, 69, 71, 84 bifurcation 64 second high pressure pipe 67, 67*a*, 67*b* first high pressure pipe 70, 70*a*, 70*b* low pressure pipe

80, 81, 82, 82*a*, 82*b*, 83*a*, 83*b* refrigerant pipe 100 valve main body 101 cylinder 102 slide table 103 slide valve 104, 105 piston 106 first chamber 107 second chamber 110, 111, 112, 113 pilot pipe 120 pilot solenoid valve

The invention claimed is:

1. A refrigeration cycle apparatus comprising:

a first four-way valve having a first port, a second port, a third port, and a fourth port;

a second four-way valve and a third four-way valve each having a fifth port, a sixth port, a seventh port, and an eighth port, the eighth port being closed;

a compressor having a suction port from which refrigerant is sucked into the compressor and a discharge port from which the refrigerant is discharged from the compressor;

a discharge pipe connecting the discharge port and the first port;

a suction pipe connecting the suction port and the second port;

a first high pressure pipe connecting the discharge pipe and the fifth port of the second four-way valve and the fifth port of the third four-way valve;

a second high pressure pipe connecting the third port and a bifurcation provided at the first high pressure pipe;

a first valve provided at part of the first high pressure pipe that is located between the discharge pipe and the bifurcation, the first valve being an electronic expansion valve;

a second valve provided at the second high pressure pipe;

a low pressure pipe connecting the suction pipe and the sixth port of the second four-way valve and the sixth port of the third four-way valve;

a first outdoor heat exchanger connected with the seventh port of the second four-way valve;

a second outdoor heat exchanger connected with the seventh port of the third four-way valve; and an indoor heat exchanger connected with the fourth port, wherein the refrigeration cycle apparatus is configured to perform a heating operation in which the first outdoor heat exchanger and the second outdoor heat exchanger operate as evaporators and the indoor heat exchanger operates as a condenser, a defrosting operation in which the first outdoor heat exchanger and the second outdoor heat exchanger operate as condensers, and a simultaneous heating and defrosting operation in which one of the first outdoor heat exchanger and the second outdoor heat exchanger operates as an evaporator and the other of the first outdoor heat exchanger and the second outdoor heat exchanger and the indoor heat exchanger operate as condensers, wherein during the heating operation, the first four-way valve is set to cause the first port and the fourth port to communicate with each other and to cause the second port and the third port to communicate with each other, each of the second four-way valve and the third four-way valve is set to cause the fifth port and the eighth port to communicate with each other and to cause the sixth port and the seventh port to communicate with each other, and the second valve blocks a flow of the refrigerant from the bifurcation toward the third port, wherein during the defrosting operation, the first four-way valve is set to cause the first port and the third port to communicate with each other and to cause the second port and the fourth port to communicate with each other, each of the second four-way valve and the third four-way valve is set to cause the fifth port and the seventh port to communicate with each other and to cause the sixth port and the eighth port to communicate with each other, and the second valve allows a flow of the refrigerant from the third port toward the bifurcation, and wherein during the simultaneous heating and defrosting operation, the first four-way valve is set to cause the first port and the fourth port to communicate with each other and to cause the second port and the third port to communicate with each other, one of the second four-way valve and the third four-way valve is set to cause the fifth port and the eighth port to communicate with each other and to cause the sixth port and the seventh port to communicate with each other, the other of the second four-way valve and the third four-way valve is set to cause the fifth port and the seventh port to communicate with each other and to cause the sixth port and the eighth port to communicate with each other, the first valve is set to be in an opened state, and the second valve blocks the flow of the refrigerant from the bifurcation toward the third port.

2. The refrigeration cycle apparatus of claim 1, wherein the second valve is a check valve.

3. The refrigeration cycle apparatus of claim 1, further comprising a controller, wherein the controller is configured to cause a simultaneous heating and defrosting operation to be performed, in which one of the first outdoor heat exchanger and the second outdoor heat exchanger operates as an evaporator, and the other of the first outdoor heat exchanger and the second outdoor heat exchanger and the indoor heat exchanger operate as condensers, and wherein the controller is configured to control, in the simultaneous heating and defrosting operation, an opening degree of the first valve such that a pressure of high pressure gas refrigerant that is discharged from the compressor and is branched from the discharge pipe to the first high pressure pipe is reduced to an intermediate pressure.

4. The refrigeration cycle apparatus of claim 1, further comprising a controller, wherein the compressor is configured to operate at a variable operating frequency that falls within a predetermined operating frequency range, and the controller is configured to cause the simultaneous heating and defrosting operation to be performed after the heating operation, in a case where during the heating operation, a value obtained by subtracting the operating frequency of the compressor from a maximum operating frequency that is an upper limit of the operating frequency range is greater than or equal to a threshold, and cause the defrosting operation to be performed after the heating operation, in a case where during the heating operation, the value obtained by subtracting the operating frequency of the compressor from the maximum operating frequency is less than the threshold.

5. The refrigeration cycle apparatus of claim 4, wherein the controller is configured to cause the defrosting operation to be performed, in a case where the number of times the simultaneous heating and defrosting operation is performed after last performance of the defrosting operation reaches a threshold number of times.

* * * * *